US011305954B2

(12) United States Patent
Miyasaka

(10) Patent No.: US 11,305,954 B2
(45) Date of Patent: Apr. 19, 2022

(54) USED PAPER SUPPLY DEVICE AND SHEET MANUFACTURING APPARATUS

(71) Applicant: SEIKO EPSON CORPORATION, Tokyo (JP)

(72) Inventor: Yoichi Miyasaka, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 140 days.

(21) Appl. No.: 16/492,199

(22) PCT Filed: Feb. 2, 2018

(86) PCT No.: PCT/JP2018/003631

§ 371 (c)(1),
(2) Date: Sep. 9, 2019

(87) PCT Pub. No.: WO2018/163681

PCT Pub. Date: Sep. 13, 2018

(65) Prior Publication Data

US 2020/0039769 A1 Feb. 6, 2020

(30) Foreign Application Priority Data

Mar. 10, 2017 (JP) ..... JP2017-045784

(51) Int. Cl.

| | |
|---|---|
| ***B65H 1/14*** | (2006.01) |
| ***B27N 3/04*** | (2006.01) |
| ***B65H 3/12*** | (2006.01) |
| ***B65H 3/44*** | (2006.01) |
| ***B65H 3/06*** | (2006.01) |
| ***B65H 7/02*** | (2006.01) |

(Continued)

(52) U.S. Cl.

CPC ..... *B65H 1/14* (2013.01); *B27N 3/04* (2013.01); *B65H 3/06* (2013.01); *B65H 3/12* (2013.01); *B65H 3/44* (2013.01); *B65H 3/446* (2013.01); *B65H 7/02* (2013.01); *B65H 7/20* (2013.01); *D21B 1/063* (2013.01); *B41J 29/17* (2013.01);

(Continued)

(58) Field of Classification Search

CPC ... B65H 1/14; B65H 1/28; B65H 3/06; B65H 3/44; B65H 3/46; B65H 3/5261; B65H 7/00; B65H 7/02; B65H 7/14; B65H 7/16; B65H 7/18; B65H 7/20; B65H 2406/12; B65H 2301/531; B65H 2511/30; B65H 2513/53; B65H 3/446; B41J 29/17

See application file for complete search history.

(56) References Cited

U.S. PATENT DOCUMENTS 1,668,967 A * 5/1928 Labombarde ..... B65H 3/0646 271/37
6,055,407 A * 4/2000 Inoue ..... B65H 3/06 271/119

(Continued)

FOREIGN PATENT DOCUMENTS

JP 07-215510 A 8/1995
JP 08-217279 A 8/1996

(Continued)

*Primary Examiner* — Prasad V Gokhale

(74) *Attorney, Agent, or Firm* — Global IP Counselors, LLP

(57) ABSTRACT

A used paper supply device includes a first paper feed unit and a second paper feed unit for feeding used paper and cleaning unit for cleaning a surface of a roller of the paper feed units, in which when the used paper is fed from the first paper feed unit, the surface of the roller of the second paper feed unit is cleaned.

6 Claims, 13 Drawing Sheets

(51) Int. Cl.

| | |
|---|---|
| ***B65H 7/20*** | (2006.01) |
| ***D21B 1/06*** | (2006.01) |
| *B41J 29/17* | (2006.01) |
| *B65H 3/46* | (2006.01) |
| *B65H 5/00* | (2006.01) |
| *B65H 7/12* | (2006.01) |

(52) U.S. Cl.
CPC ..... *B65H 3/46* (2013.01); *B65H 5/00* (2013.01); *B65H 7/12* (2013.01); *B65H 2301/531* (2013.01); *B65H 2511/528* (2013.01)

(56) References Cited

U.S. PATENT DOCUMENTS

| | | | | |
|---|---|---|---|---|
| 2002/0050680 | A1* | 5/2002 | Yanagi | B65H 3/0661 271/121 |
| 2007/0231033 | A1* | 10/2007 | Okazaki | B65H 5/062 399/388 |
| 2009/0140489 | A1* | 6/2009 | Takeuchi | B65H 1/14 271/109 |
| 2010/0001454 | A1* | 1/2010 | Okumura | B65H 3/60 271/97 |
| 2010/0117290 | A1* | 5/2010 | Izumichi | B65H 3/0607 271/11 |

FOREIGN PATENT DOCUMENTS

| | | | |
|---|---|---|---|
| JP | 2000-335770 | A | 12/2000 |
| JP | 2000-347546 | A | 12/2000 |
| JP | 2004-018159 | A | 1/2004 |
| JP | 6590900 | B2 | 9/2014 |
| JP | 2016-113712 | A | 6/2016 |

* cited by examiner

USED PAPER SUPPLY DEVICE AND SHEET MANUFACTURING APPARATUS

CROSS-REFERENCE TO RELATED APPLICATIONS

This application is a U.S. National stage application of International Patent Application No. PCT/JP2018/003631, filed on Feb. 2, 2018, which claims priority under 35 U.S.C. § 119(a) to Japanese Patent Application No. 2017-045784, filed in Japan on Mar. 10, 2017. The entire disclosure of Japanese Patent Application No. 2017-045784 is hereby incorporated herein by reference.

TECHNICAL FIELD

The present invention relates to a used paper supply device and a sheet manufacturing apparatus.

TECHNICAL FIELD

In the related art, a sheet manufacturing apparatus which inserts a removing member into a conveying unit and removes an attached substance attached to the conveying unit is known (for example, see Japanese Unexamined Patent Application Publication No. 2016-113712).

However, in the above apparatus, there is a problem in that when the removing member is inserted into the conveying unit, since it is required to stop sheet manufacturing, an operation rate of the apparatus becomes degraded.

SUMMARY

The present invention has been made to solve at least a part of the above-described problems, and can be realized as the following aspects or application examples.

Application Example 1

A used paper supply device according to the present application example includes a first paper feed unit and a second paper feed unit for feeding used paper and a cleaning unit for cleaning a surface of a roller of the paper feed units, in which when the used paper is fed from the first paper feed unit, the surface of the roller of the second paper feed unit is cleaned.

According to the configuration, when one paper feed unit of the first paper feed unit and the second paper feed unit is in a paper feeding state, the roller of the other paper feed unit is cleaned. In the cleaning of the roller, a toner, ink, dirt such as paper dust adhering to the roller is removed. Accordingly, a paper feeding error can be suppressed by operating the paper feed unit while switching the paper feed unit. Therefore, the operation rate of the used paper supply device can be increased.

Application Example 2

In the used paper supply device according to the above application example, the surface of the roller is cleaned each time a predetermined number of papers, a predetermined length or a predetermined weight of the paper is fed.

According to the configuration, the rollers are periodically cleaned (according to the paper feed amount), and the first paper feed unit and the second paper feed unit are switched to perform paper feeding. Accordingly, the paper feeding error can be suppressed.

Application Example 3

In the used paper supply device according to the above application example, the surface of the roller is cleaned each time a paper feeding state passes a predetermined time.

According to the configuration, the rollers are cleaned at regular time intervals and the first paper feed unit and the second paper feed unit are switched to perform paper feeding. Accordingly, the paper feeding error can be suppressed.

Application Example 4

The used paper supply device according to the above application example includes prediction means for predicting a timing to clean the surface of the roller.

According to the configuration, since the time to clean is predicted, cleaning of the roller can be performed before a paper feeding error occurs. Accordingly, the paper feeding error can be suppressed.

Application Example 5

The paper feed unit of the used paper supply device according to the above application example includes a tray that stores the used paper to be fed and a moving mechanism for moving the tray between a paper feed position and a retracted position, and during cleaning the surface of the roller, the tray is moved to the retracted position.

According to the configuration, during roller cleaning, the tray moves away from the roller. Accordingly, it is possible to prevent foreign substances such as paper dust removed from the roller from adhering to the used paper stored in the paper feed tray.

Application Example 6

In the used paper supply device according to the above application example, a cover that covers the roller is provided near the roller and on an upstream side of the roller.

According to the configuration, the cover separates the roller from the used paper to be fed. Accordingly, it is possible to prevent the foreign substances such as paper dust removed from the roller from adhering to the used paper stored in the tray.

Application Example 7

A sheet manufacturing apparatus according to the present application example includes the above-described used paper supply device.

According to the configuration, supply of the used paper is stably performed and a high quality sheet can be manufactured.

DESCRIPTION OF EMBODIMENTS

Hereinafter, first to third embodiments of the present invention will be described with reference to the drawings. Moreover, in each view described below, in order to make each member and the like be recognizable sizes, scales of each member and the like are different from actual sizes.

First Embodiment

Figure 1:
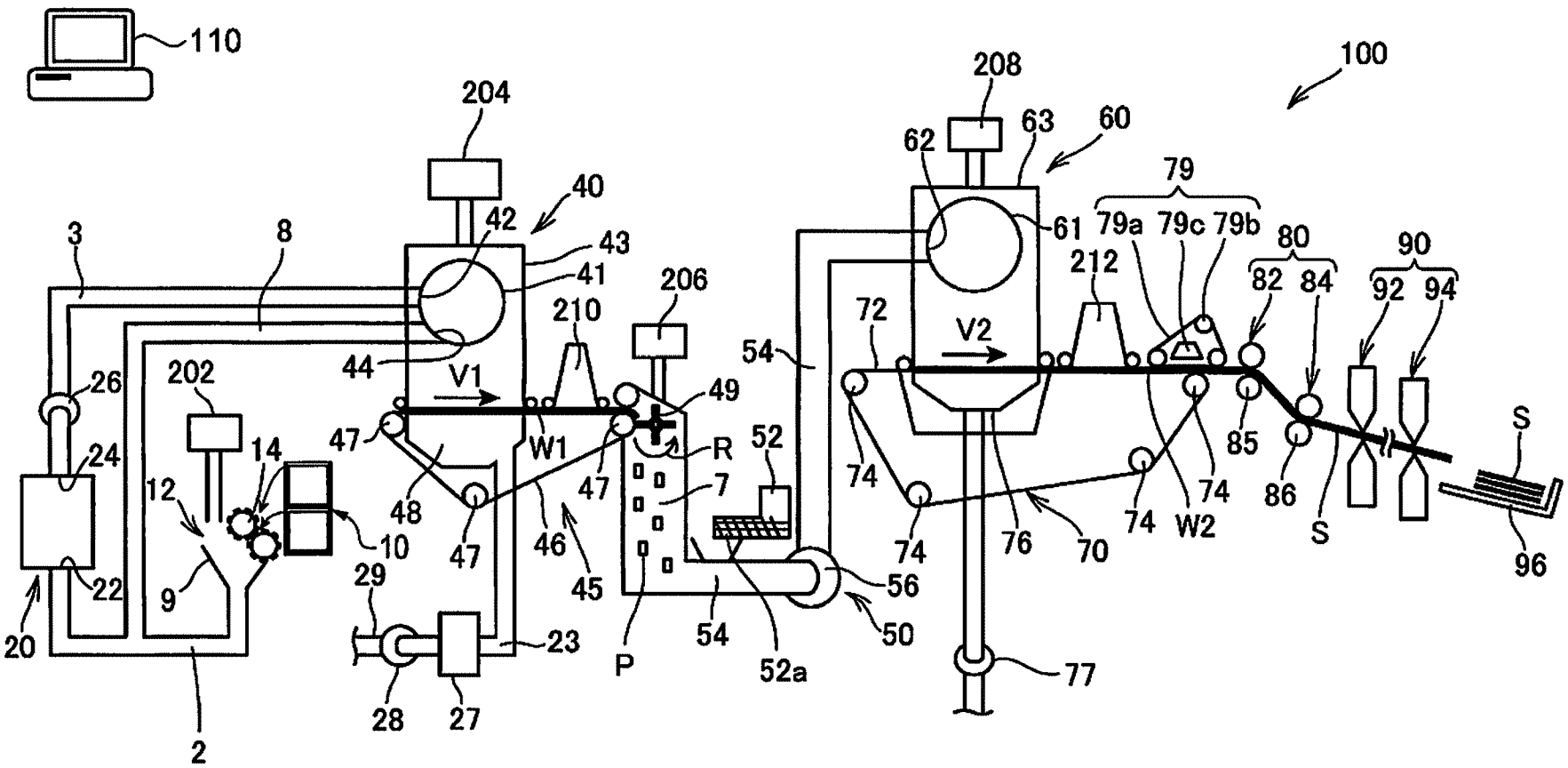
FIG. 1 is a schematic view showing a configuration of a sheet manufacturing apparatus according to a first embodiment.

FIG. 1 is a schematic view showing a configuration of a sheet manufacturing apparatus 100 according to a first embodiment.

For example, the sheet manufacturing apparatus 100 described in the embodiment is an apparatus that is suitable for defibrating used paper such as confidential paper as a raw material in a dry method such that the paper is fiberized and, then, manufacturing new paper through pressurization, heating, and cutting. The fiberized raw material is mixed with various additives, and thereby bond strength or a whiteness level of a paper product may improve or a function of coloring, scenting, or flame resisting may be added, depending on a use. In addition, forming is performed by controlling density, a thickness, and a shape of paper, and thereby it is possible to manufacture paper having various thicknesses or sizes, depending on a use such as office paper having an A4 or A3 size or business card paper.

The sheet manufacturing apparatus 100 includes a supply unit 10 as the used paper supply device, a rough crushing unit 12, a defibration unit 20, a sorting unit 40, a first web former 45, a rotary body 49, a mixer 50, an accumulation unit 60, a second web former 70, a conveying unit 79, a sheet former 80, a cutter 90, and a controller 110.

In addition, the sheet manufacturing apparatus 100 includes humidifying units 202, 204, 206, 208, 210, and 212 for the purpose of humidifying the raw material and/or a space through which the raw material moves. The humidifying units 202, 204, 206, 208, 210, and 212 have any specific configurations, and examples thereof include a steam type, a vaporization type, a hot air vaporization type, an ultrasound type, or the like.

In the embodiment, the humidifying units 202, 204, 206, and 208 are each configured of a vaporization-type or hot air vaporization-type humidifier. In other words, each of the humidifying units 202, 204, 206, and 208 has a filter (not illustrated) into which water infiltrates and causes air to pass through the filter, thereby supplying humidified air having high humidity. In addition, the humidifying units 202, 204, 206, and 208 may include heaters (not illustrated) that effectively increase the humidity of the humidified air.

In addition, in the embodiment, the humidifying unit 210 and the humidifying unit 212 are each configured of an ultrasound type humidifier. In other words, each of the humidifying units 210 and 212 has a vibrating unit (not illustrated), which atomizes water, and supplies mist generated by the vibrating unit.

The supply unit 10 supplies the raw material (for example, supplying used paper) to the rough crushing unit 12. The raw material from which the sheet manufacturing apparatus 100 manufactures a sheet may contain a fiber and examples of the raw material include a paper, a pulp, a pulp paper, a cloth containing a nonwoven fabric, or textiles or the like. In the present embodiment, a configuration in which the sheet manufacturing apparatus 100 uses the used paper as a raw material is exemplified. The supply unit 10 can be configured to include, for example, a stacker that accumulates and accumulates the used paper pieces, and an automatic feeding device that feeds the used paper from the stacker to the rough crushing unit 12.

The detailed configuration of the supply unit 10 will be described.

The rough crushing unit 12 has rough crushing blades 14 that cuts (roughly crushes) the raw material supplied by the supply unit 10 into rough-crushed pieces. The rough crushing blades 14 cut the raw material in a gas atmosphere such as in the atmosphere (in the air). For example, the rough crushing unit 12 includes a pair of rough crushing blades 14, which pinches and cuts the raw material, and a driving unit, which rotates the rough crushing blades 14, and the rough crushing unit can have the same configuration as that of a so-called shredder. The rough-crushed pieces may have any shape or size as long as the shape or size is suitable for a defibrating process in the defibration unit 20. For example, the rough crushing unit 12 cuts the raw material into paper pieces having a size equal to or smaller than 1 square centimeter to several square centimeters.

The rough crushing unit 12 has a chute (hopper) 9 that receives the rough-crushed pieces which are cut by the rough crushing blades 14 and fall down. For example, the chute 9 has a tapered shape having a width that is gradually decreased in a direction (proceeding direction) in which the rough-crushed pieces flow. Therefore, the chute 9 is capable of receiving a large amount of rough-crushed pieces. A pipe 2 that communicates with the defibration unit 20 is connected to the chute 9, and the pipe 2 forms a conveying channel for conveying the raw material (rough-crushed pieces) cut by the rough crushing blades 14 to the defibration unit 20. The rough-crushed pieces are gathered by the chute 9 and are conveyed (conveyed) to the defibration unit 20 through the pipe 2. The rough-crushed pieces are conveyed in the pipe 2 toward the defibration unit 20, for example, by an air flow generated by a blower (not illustrated).

The humidifying unit 202 supplies humidified air to the chute 9 or the vicinity of the chute 9 included in the rough crushing unit 12. Consequently, it is possible to suppress a phenomenon in which rough-crushed materials cut by the rough crushing blades 14 are attached to an inner surface of the chute 9 or the pipe 2 due to static electricity. In addition, the rough-crushed materials cut by the rough crushing blades 14 are conveyed together with humidified air (having high humidity) to the defibration unit 20, and thus it is also possible to expect an effect of suppressing attachment of a defibrated substance to an inside of the defibration unit 20. In addition, the humidifying unit 202 may be configured to supply the humidified air to the rough crushing blades 14 so as to remove electricity from the raw material that is supplied by the supply unit 10. In addition, an ionizer together with the humidifying unit 202 may remove electricity.

The defibration unit 20 defibrates rough crushed materials cut by the rough crushing unit 12. More specifically, the defibration unit 20 performs a defibrating process on the raw material (rough crushed pieces) cut by the rough crushing unit 12 and generates the defibrated substance. Here, "to defibrate" means to unravel fibers one by one from the raw material (defibration target object) in which a plurality of fibers are bound. The defibration unit 20 also has a function of separating a substance such as a resin grain, ink, toner, or a bleeding preventive agent, which is attached to the raw material, from the fiber.

A substance having passed through the defibration unit 20 is referred to as the "defibrated substance". The "defibrated substance" includes a resin (resin for binding a plurality of fibers to each other) grain, a coloring agent such as ink or toner, or an additive such as a bleeding preventive agent or a paper strengthening agent, which is separated from the fiber when the fiber is unraveled, in addition to an unraveled defibrated fiber, in some cases. The unraveled defibrated substance which has a string shape or a ribbon shape. The unraveled defibrated substance may be present in a state in which the substance is not intertwined with another unraveled fiber (an independent state) or may be present in a state in which the substance is intertwined with another unraveled defibrated substance into a blocking shape (a state of forming a so-called "clump").

The defibration unit 20 performs dry defibration. Here, defibration performed through a process of defibration not in a liquid but in a gas such as in the atmosphere (in the air) is referred to as the dry defibration. In the embodiment, the defibration unit 20 is configured of an impeller mill. Specifically, the defibration unit 20 includes a rotor (not illustrated) that rotates at a high speed and a liner (not illustrated) that is positioned along an outer circumference of the roller. The rough-crushed pieces that have been cut by the rough crushing unit 12 are sandwiched between the rotor and the liner of the defibration unit 20 so as to be defibrated. The defibration unit 20 generates an air flow due to the rotation of the rotor. The air flow enables the defibration unit 20 to suction the rough-crushed pieces which are the raw material from the pipe 2 and convey the defibrated substance to a discharge port 24. The defibrated substance is delivered to a pipe 3 from the discharge port 24 and is conveyed to the sorting unit 40 via the pipe 3.

In this manner, the defibrated substance that is generated in the defibration unit 20 is conveyed to the sorting unit 40 from the defibration unit 20 due to the air flow that is generated by the defibration unit 20. Further, in the embodiment, the sheet manufacturing apparatus 100 includes a defibration unit blower 26 that is an air flow generating device, and the defibrated substance is conveyed to the sorting unit 40 due to the air flow generated by the defibration unit blower 26. The defibration unit blower 26 is attached to the pipe 3, suctions air together with the defibrated substance from the defibration unit 20, and performs blowing to the sorting unit 40.

The sorting unit 40 is provided with an introduction port 42 into which the defibrated substance defibrated by the defibration unit 20 flows along with the air flow from the pipe 3. The sorting unit 40 sorts the defibrated substance introduced to the introduction port 42 depending on a length of fiber. To be more specific, the sorting unit 40 sorts a defibrated substance having a size equal to or smaller than a predetermined size into a first sorted substance, and a defibrated substance that is larger than the first sorted substance into a second sorted substance, of defibrated substances defibrated by the defibration unit 20. The first sorted substance includes a fiber, a grain, or the like, and a second sorted substance includes a long fiber, an incompletely defibrated piece (rough-crushed piece that is not sufficiently defibrated), a clump formed by clumping or entwining the defibrated fibers, or the like.

In the embodiment, the sorting unit 40 has a drum portion (sieve portion) 41 and a housing portion (cover portion) 43 that accommodates the drum portion 41.

The drum portion 41 is a cylinder sieve that is rotatably driven by a motor. The drum portion 41 has a net (a filter or a screen) and functions as a sieve (sieve). The drum portion 41 sorts into the first sorted substance smaller than a size of a mesh opening (opening) of the net and the second sorted substance larger than the mesh opening of the net, by meshes of the net. As the net of the drum portion 41, a wire mesh, expanded metal obtained by expanding a metal plate provided with cuts, or punched metal provided with holes formed in a metal plate by a press machine can be used.

The defibrated substance introduced into the introduction port 42 is delivered along with the air flow into the inside of the drum portion 41, and the first sorted substance falls downward from the mesh of the net of the drum portion 41 due to the rotation of the drum portion 41. The second sorted substance that cannot pass through the mesh of the net of the drum portion 41 flows to be guided to a discharge port 44 and is delivered to a pipe 8 along with the air flow flowing to the drum portion 41 from the introduction port 42.

The pipe 8 connects the inside of the drum portion 41 to the pipe 2. The second sorted substance flowing through the pipe 8 flows to the pipe 2 along with the rough-crushed pieces that have been cut by the rough crushing unit 12 and is guided to an introduction port 22 of the defibration unit 20. Consequently, the second sorted substance returns to the defibration unit 20 and is subjected to a defibrating process.

In addition, the first sorted substances sorted by the drum portion 41 are dispersed in the air through the meshes of the net of the drum portion 41 and drop toward a mesh belt 46 of the first web former 45 that is positioned below the drum portion 41.

The first web former 45 (separation unit) includes the mesh belt 46 (separation belt), a roller 47, and a suction unit (suction mechanism) 48. The mesh belt 46 is an endless belt, is suspended on three rollers 47, and is conveyed along with motion of the rollers 47 in a direction represented by an arrow in the drawing. The mesh belt 46 has a surface configured of a net in which openings having a predetermined size are arranged. Among the first sorted substances dropping from the sorting unit 40, fine particles having a size to the extent that it is possible to pass through the mesh of the net fall downward from the mesh belt 46, and fibers having a size to the extent that it is not possible to pass through the mesh of the net are accumulated on the mesh belt 46 and are conveyed along with the mesh belt 46 in an arrow direction. The fine particles falling from the mesh belt 46 include a relatively small substance or a substance having low density (such as a resin grain, a coloring agent, or an additive) of the defibrated substances and are substances to be removed, which are not used in manufacturing of a sheet S by the sheet manufacturing apparatus 100.

The mesh belt 46 moves at a constant speed V1 at the time of a normal operation of manufacturing the sheet S. Here, the time of the normal operation means a time of an operation excluding times of execution of start control and stop control of the sheet manufacturing apparatus 100 to be described and, to be more specific, indicates while the sheet manufacturing apparatus 100 manufactures the sheet S having a desired quality.

Hence, the defibrated substances subjected to the defibrating process by the defibration unit 20 are sorted into the first sorted substances and the second sorted substances by the sorting unit 40, and the second sorted substances return to the defibration unit 20. In addition, the first web former 45 removes the substance to be removed from the first sorted substances. The rest of the first sorted substances obtained by removing the substance to be removed are materials suitable for manufacturing the sheet S, and the materials are accumulated on the mesh belt 46 so as to form a first web W1.

The suction unit 48 suctions air from below the mesh belt 46. The suction unit 48 is connected to a dust collecting unit 27 via a pipe 23. The dust collecting unit 27 is a filter-type or cyclone-type dust collecting device and separates fine particles from the air flow. A trapping blower 28 is installed downstream of the dust collecting unit 27, and the trapping blower 28 functions as a suction unit for dust collecting that suctions air from the dust collecting unit 27. In addition the air discharged by the trapping blower 28 is discharged out of the sheet manufacturing apparatus 100 via the pipe 29.

In this configuration, air from the suction unit 48 is suctioned by the trapping blower 28 through the dust collecting unit 27. In the suction unit 48, the fine particles that pass through the meshes of the net of the mesh belt 46 are suctioned along with the air and are set to the dust collecting unit 27 through the pipe 23. The dust collecting unit 27 separates the fine particles having passed through the mesh belt 46 from the air flow so as to accumulate the fine particles.

Hence, fibers obtained by removing the substances to be removed from the first sorted substance are accumulated on the mesh belt 46 such that the first web W1 is formed. The trapping blower 28 performs suction, thereby, promoting to form the first web W1 on the mesh belt 46, and the substances to be removed are rapidly removed.

The humidified air generated by the humidifying unit 204 is supplied to a space including the drum portion 41. The first sorted substance is humidified with the humidified air inside the sorting unit 40. Consequently, it is possible to weaken attachment of the first sorted substance to the mesh belt 46 due to an electrostatic force and peel the first sorted substance from the mesh belt 46 easily. Further, it is possible to suppress attachment of the first sorted substance to an inner wall of the rotary body 49 or the housing portion 43 due to the electrostatic force. In addition, the suction unit 48 is capable of suctioning the substance to be removed efficiently.

In the sheet manufacturing apparatus 100, a configuration of sorting and separating the first sorted substance and the second sorted substance from each other is not limited to the sorting unit 40 that includes the drum portion 41. For example, a configuration may be employed, in which the defibrated substances subjected to the defibrating process by the defibration unit 20 are classified by a classifier. For example, it is possible to use a cyclone classifier, an elbow jet classifier, or an eddy classifier as the classifier. When the classifiers are used, it is possible to sort and separate the first sorted substance and the second sorted substance from each other. Further, the classifier can realize a configuration of separating and removing the substance to be removed, which includes a relatively small substance or a substance having low density (such as a resin grain, a coloring agent, or an additive) of the defibrated substances. For example, in the configuration, the fine particles contained in the first sorted substance may be removed from the first sorted substance by the classifier. In this case, it is possible to employ a configuration in which the second sorted substance returns to the defibration unit 20, for example, the substances to be removed are collected by the dust collecting unit 27, and the first sorted substance is sent to a pipe 54 without the substances to be removed.

In a conveyance route of the mesh belt 46, the humidifying unit 210 supplies air containing mist to a downstream side of the sorting unit 40. The mist which is fine particles of water generated by the humidifying unit 210 drops toward the first web W1 and supplies moisture to the first web W1. Consequently, it is possible to adjust an amount of moisture contained in the first web W1, and thus it is possible to suppress attachment or the like of a fiber to the mesh belt 46 due to the static electricity.

The sheet manufacturing apparatus 100 includes the rotary body 49 that divides the first web W1 accumulated on the mesh belt 46. The first web W1 is peeled from the mesh belt 46 and is divided by the rotary body 49 at a position at which the mesh belt 46 is bent by the roller 47.

The first web W1 is a soft material having a web shape, which is formed of the accumulated fibers, and the rotary body 49 loosens the fibers of the first web W1 so as to perform a process of proceeding to a state in which it is easy to mix a resin with the fibers by the mixer 50 to be described below.

The rotary body 49 has any configuration; however, in the embodiment, it is possible to have a rotating vane shape by having a plate-shaped vane that rotates. The rotary body 49 is disposed at a position at which the vane comes into contact with the first web W1 peeled from the mesh belt 46. The rotary body 49 rotates (for example, rotates in a direction represented by an arrow R in the drawing), and thereby the vane collides with the first web W1, which is peeled from the mesh belt 46 so as to be conveyed, such that the first web is divided, and a subdivided body P is generated.

It is preferable that the rotary body 49 be installed at a position at which the vane of the rotary body 49 does not collide with the mesh belt 46. For example, it is possible to have a gap of 0.05 mm or larger and 0.5 mm or smaller between a distal end of the vane of the rotary body 49 and the mesh belt 46. In this case, it is possible to divide the first web W1 efficiently without damage to the mesh belt 46 by the rotary body 49.

The subdivided body P divided by the rotary body 49 drops to an inside of a pipe 7 so as to be conveyed (conveyed) to the mixer 50 along with an air flow flowing in the inside of the pipe 7.

In addition, the humidified air generated by the humidifying unit 206 is supplied to a space including the rotary body 49. Consequently, it is possible to suppress a phenomenon in which the fibers are attached to the inside of the pipe 7 or the vane of the rotary body 49 due to static electricity. In addition, air having high humidity is supplied to the mixer 50 through the pipe 7, and thus it is possible to suppress an influence of the static electricity even in the mixer 50.

The mixer 50 communicates with an additive supply unit 52 that supplies an additive including a resin and the pipe 7 and includes the pipe 54, through which an air flow containing the subdivided body P flows, and a mixing blower 56.

The subdivided body P is a fiber obtained by removing the substance to be removed from the first sorted substance having passed through the first sorting unit 40 as described above. The mixer 50 mixes the fiber configuring the subdivided body P and an additive including a resin.

In the mixer 50, the subdivided body P and the resin are conveyed while the mixing blower 56 generates an air flow, and the subdivided body and the additive are mixed in the pipe 54. In addition, the subdivided body P is loosened in a process of flowing inside the pipe 7 and the pipe 54 so as to have a finer fiber shape.

The additive supply unit 52 (resin container) connects to an additive cartridge (not illustrated) that accumulates the additives to supply an additive inside the additive cartridge to the pipe 54. The additive cartridge may be configured to be removable from the additive supply unit 52. In addition, the additive cartridge may be provided with a configuration for replenishing the additive. The additive supply unit 52 temporarily stores an additive formed of fine powders or fine particles inside the additive cartridge. The additive supply unit 52 includes a discharge unit 52*a* (resin supply unit) that sends the additive once stored to the pipe 54.

The discharge unit 52*a* includes a feeder (not illustrated) for delivering the additive stored in the additive supply unit 52 to the pipe 54, and a shutter (not illustrated) for opening and closing the pipe channel connecting a feeder and the pipe 54. When the shutter is closed, the conduit or opening connecting the discharge unit 52*a* and the pipe 54 is blocked, and the supply of the additive from the additive supply unit 52 to the pipe 54 is stopped.

In a state in which the feeder of the discharge unit 52*a* does not operate, the additive is not supplied to the pipe 54 from the discharge unit 52*a*; however, in a case or the like where a pressure in the pipe 54 is a negative pressure, there is a possibility that the additive will flow to the pipe 54 even when the feeder of the discharge unit 52*a* is stopped. The discharge unit 52*a* is closed, and thereby it is possible to reliably block the flowing of the additive.

The additive that is supplied by the additive supply unit 52 includes a resin for binding a plurality of fibers. The resin included in the additive is a thermoplastic resin or a thermosetting resin, and examples thereof include AS resin, ABS resin, polypropylene, polyethylene, polyvinyl chloride, polystyrene, acrylic resin, polyester resin, polyethylene terephthalate, polyphenylene ether, polybutylene terephthalate, nylon, polyamide, polycarbonate, polyacetal, polyphenylene sulfide, or polyether ether ketone. The resins above may be used individually or in a proper combination thereof. In other words, the additive may contain a single substance, may be a mixture, or may contain a plurality of types of particles that are each configured of a single or a plurality of substances. In addition, the additive may have a fiber shape or a powder shape.

The resin included in the additive is melted by being heated so as to cause a plurality of fibers to be bounded to each other. Hence, in a state in which the resin is mixed with the fibers, and the resin is not heated to a temperature at which the resin is melted, the fibers are not bound to each other.

In addition, an additive that is supplied by the additive supply unit 52 may contain a colorant for coloring the fibers, a clumping inhibitor for inhibiting the fibers from clumping or the resin from clumping, or a flame retardant for retarding progression of burning of fibers or the like according to the types of the sheet to be manufactured, in addition to the resin that causes the fibers to be bound. In addition, an additive that does not contain the colorant may be colorless or have a light color to the extent that the resin looks colorless or may be white.

The subdivided body P dropping through the pipe 7 and the additive that is supplied by the additive supply unit 52 are suctioned to the inside of the pipe 54 due to the air flow generated by the mixing blower 56 and pass through the inside of the mixing blower 56. An action of the air flow generated by the mixing blower 56 and/or a rotary unit such as the vane included in the mixing blower 56 causes the additive and the fiber configured of the subdivided body P to be mixed, and a mixture (mixture of the first sorted substance and the additive) is conveyed to the accumulation unit 60 through the pipe 54.

A mechanism that mixes the first sorted substance and the additive is not particularly limited, and a mechanism that performs agitation by a vane which rotates at a high speed may be employed, or a mechanism of using rotation of a container such as a V-shaped mixer may be employed, and the mechanism may be installed in front or rear of the mixing blower 56.

The accumulation unit 60 accumulates the defibrated substance defibrated by the defibration unit 20. More specifically, the accumulation unit 60 introduces the mixture having passed through the mixer 50 from an introduction port 62 and loosens intertwined defibrated substances (fibers) so as to be dropped while the fibers are dispersed in the air. Further, in a case where the resin of the additive that is supplied from the additive supply unit 52 has a fiber shape, the accumulation unit 60 loosens the intertwined resins. Consequently, the accumulation unit 60 is capable of accumulating the mixture in the second web former 70 with good uniformity.

In the embodiment, the accumulation unit 60 has a drum portion 61 and a housing portion (cover portion) 63 that accommodates the drum portion 61. The drum portion 61 is a cylinder sieve that is rotatably driven by a motor. The drum portion 61 has a net (a filter or a screen) and functions as a sieve. The drum portion 61 allows fibers or particles that are smaller than a mesh opening (opening) of the net through the mesh of the net and to be dropped from the drum portion 61. For example, a configuration of the drum portion 61 is the same as the configuration of the drum portion 41.

The "sieve" of the drum portion 61 may not have a function of sorting a specific target object. In other words, the "sieve" used as the drum portion 61 means a member having a net, and the drum portion 61 may allow the entire mixture introduced to the drum portion 61 to be dropped.

The second web former 70 is disposed below the drum portion 61. The second web former 70 accumulates passing substances having passed through the accumulation unit 60, and a second web W2 is formed. For example, the second web former 70 includes a mesh belt 72, a stretching roller 74, and a suction mechanism 76.

The mesh belt 72 is an endless belt, is suspended on a plurality of rollers 74, and is conveyed along with motion of the rollers 74 in a direction represented by an arrow in the drawing. For example, the mesh belt 72 is made of metal, resin, fabric, or nonwoven fabric. The mesh belt 72 has a surface configured of a net in which openings having a predetermined size are arranged. Among the first fibers or particles dropping from the drum portion 61, fine particles having a size to the extent that it is possible to pass through the mesh of the net fall downward from the mesh belt 72, and fibers having a size to the extent that it is not possible to pass through the mesh of the net are accumulated on the mesh belt 72 and are conveyed along with the mesh belt 72 in an arrow direction. The mesh belt 72 moves at a constant speed V2 at the time of a normal operation of manufacturing the sheet S. The time of the normal operation has a meaning as described above.

The mesh belt 72 has minute meshes of the net, and the mesh can have a size so as not to allow most of the fibers or particles dropping from the drum portion 61 to pass through the mesh belt.

The suction mechanism 76 is provided below the mesh belt 72 (on a side opposite to a side of the accumulation unit 60). The suction mechanism 76 includes a suction blower 77, and thus it is possible to generate an air flow (air flow toward the mesh belt 72 from the accumulation unit 60) toward below the suction mechanism 76 with a suction force of the suction blower 77.

The suction mechanism 76 suctions mixtures dispersed in the air by the accumulation unit 60 to the mesh belt 72. Consequently, it is possible to promote forming of the second web W2 on the mesh belt 72 and to increase a discharge speed from the accumulation unit 60. Further, the suction mechanism 76 is capable of forming a down flow in a falling route of the mixture and preventing the defibrated substances and the additive from being intertwined during falling.

The suction blower 77 (accumulating suction unit) may discharge air suctioned from the suction mechanism 76 to the outside of the sheet manufacturing apparatus 100 through a trapping filter (not illustrated). Alternatively, the air suctioned by the suction blower 77 may be sent into the dust collecting unit 27, and the substance to be removed, which is contained in the air suctioned by the suction mechanism 76, may be trapped.

The humidified air generated by the humidifying unit 208 is supplied to a space including the drum portion 61. It is possible to humidify an inside of the accumulation unit 60 with the humidified air, and thus it is possible to suppress the fibers or the particles from being attached to the housing portion 63 due to the electrostatic force, to drop the fibers and the particles rapidly to the mesh belt 72, and to form the second web W2 into a preferable shape.

As described above, through the accumulation unit 60 and the second web former 70 (a web forming step), the second web W2 is formed in a state of containing a large amount of air and being soft and expanded. The second web W2 accumulated on the mesh belt 72 is conveyed to the sheet former 80.

In a conveyance route of the mesh belt 72, the humidifying unit 212 supplies air containing mist to a downstream side of the accumulation unit 60. Consequently, the mist which is generated by the humidifying unit 212 is supplied to the second web W2, and an amount of moisture contained in the second web W2 is adjusted. Consequently, it is possible to suppress attachment or the like of a fiber to the mesh belt 72 due to the static electricity.

The sheet manufacturing apparatus 100 includes the conveying unit 79 that is provided to convey the second web W2 on the mesh belt 72 to the sheet former 80. For example, the conveying unit 79 includes a mesh belt 79*a*, a roller 79*b*, and a suction mechanism 79*c*.

The suction mechanism 79*c* has a blower (not illustrated) and generates an upward air flow from the mesh belt 79*a* with a suction force of a blower. The second web W2 is suctioned along with the air flow, and the second web W2 is separated from the mesh belt 72 so as to be attached to the mesh belt 79*a*. The mesh belt 79*a* moves along with rotation of the roller 79*b* and conveys the second web W2 to the sheet former 80. For example, a movement speed of the mesh belt 72 is the same as a movement speed of the mesh belt 79*a*.

In this manner, the conveying unit 79 peels the second web W2 formed on the mesh belt 72 from the mesh belt 72 so as to convey the second web.

The sheet former 80 forms the sheet S from the accumulated object accumulated by the accumulation unit 60. More specifically, the sheet former 80 pressurizes and heats the second web W2 (accumulated object) accumulated on the mesh belt 72 and conveyed by the conveying unit 79 so as to form the sheet S. In the sheet former 80, fibers of a defibrated substance and an additive which are contained in the second web W2 are heated, and thereby a plurality of fibers in a mixture are bound to each other via the additive (resin).

The sheet former 80 has a pressurizing unit 82 that pressurizes the second web W2 and a heating unit 84 that heats the second web W2 pressurized by the pressurizing unit 82.

The pressurizing unit 82 is configured of a pair of calendar rollers 85 (roller) and nips and pressurizes the second web W2 with a predetermined nip pressure. The second web W2 decreases in thickness by being pressurized, and density of the second web W2 increases. One of the pair of calendar rollers 85 is a drive roller that is driven by the pressurizing unit driving motor, and the other roller is a driven roller. The calendar roller 85 rotates by a drive force of the pressurizing unit driving motor so as to convey the second web W2 having high density due to pressurization toward the heating unit 84.

For example, the heating unit 84 can be configured to use a heating roller (heater roller), a thermal press forming device, a hot plate, a hot air blower, an infrared heater, or a flash fixing device. In the embodiment, the heating unit 84 has a pair of heating rollers 86. The heating rollers 86 are warmed to a preset temperature by a heater that is installed inside or outside. The heating rollers 86 nips the second web W2 pressurized by the calendar roller 85 so as to apply heat to the second web, and the sheet S is formed.

One of the pair of heating rollers 86 is a drive roller that is driven by a motor (not illustrated), and the other roller is a driven roller. The heating roller 86 rotates by a drive force of the motor so as to convey the heated sheet S toward the cutter 90.

As described above, the second web W2 formed by the accumulation unit 60 is pressed and heated by the sheet former 80 to form the sheet S.

The number of the calendar rollers 85 included in the pressurizing unit 82 and the number of the heating rollers 86 included in the heating unit 84 are not particularly limited.

The cutter 90 cuts the sheet S formed by the sheet former 80. In the embodiment, the cutter 90 includes a first cutter 92 that cuts the sheet S in a direction intersecting a conveyance direction of the sheet S and a second cutter 94 that cuts the sheet S in a direction parallel to the conveyance direction. For example, the second cutter 94 cuts the sheet S having passed through the first cutter 92.

As described above, a single sheet S having a predetermined size is formed. The cut single sheet S is discharged to a discharge unit 96. The discharge unit 96 includes a tray or a stacker on which the sheet S having a predetermined size is placed.

In the above-described configuration, the humidifying units 202, 204, 206, and 208 may be configured to be a vaporization-type humidifier. In this case, a configuration may be employed, in which humidified air generated by one humidifier diverges to be supplied to the rough crushing unit 12, the housing portion 43, the pipe 7, and the housing portion 63. In the configuration, a duct (not illustrated), through which the humidified air is supplied, is installed to diverge, and thereby it is possible to easily realize supply of the humidified air. In addition, it is needless to say that the humidifying units 202, 204, 206, and 208 can be each configured of two or three vaporization-type humidifiers.

In addition, in the above-described configuration, the humidifying units 210 and 212 may be configured of one ultrasound type humidifier or may be configured of two ultrasound type humidifier. For example, it is possible to employ a configuration in which air containing mist generated by one humidifier diverges to be supplied to the humidifying unit 210 and the humidifying unit 212.

In addition, in the above-described configuration, the rough crushing unit 12 first roughly crushes the raw material, and the sheet S is manufactured from the roughly crushed raw material; however, it is also possible to employ a configuration in which the sheet S is manufactured by using the fibers as the raw material.

For example, a configuration may be employed, in which it is possible to feed, as the raw material, fibers equivalent to the defibrated substances subjected to the defibrating process by the defibration unit 20, to the drum portion 41. In addition, a configuration may be employed, in which it is possible to feed, as the raw material, fibers equivalent to the first sorted substances separated from the defibrated substances to the pipe 54. In this case, fibers obtained by processing used paper, pulp, or the like are supplied to the sheet manufacturing apparatus 100, and thereby it is possible to manufacture the sheet S.

Figure 2A:
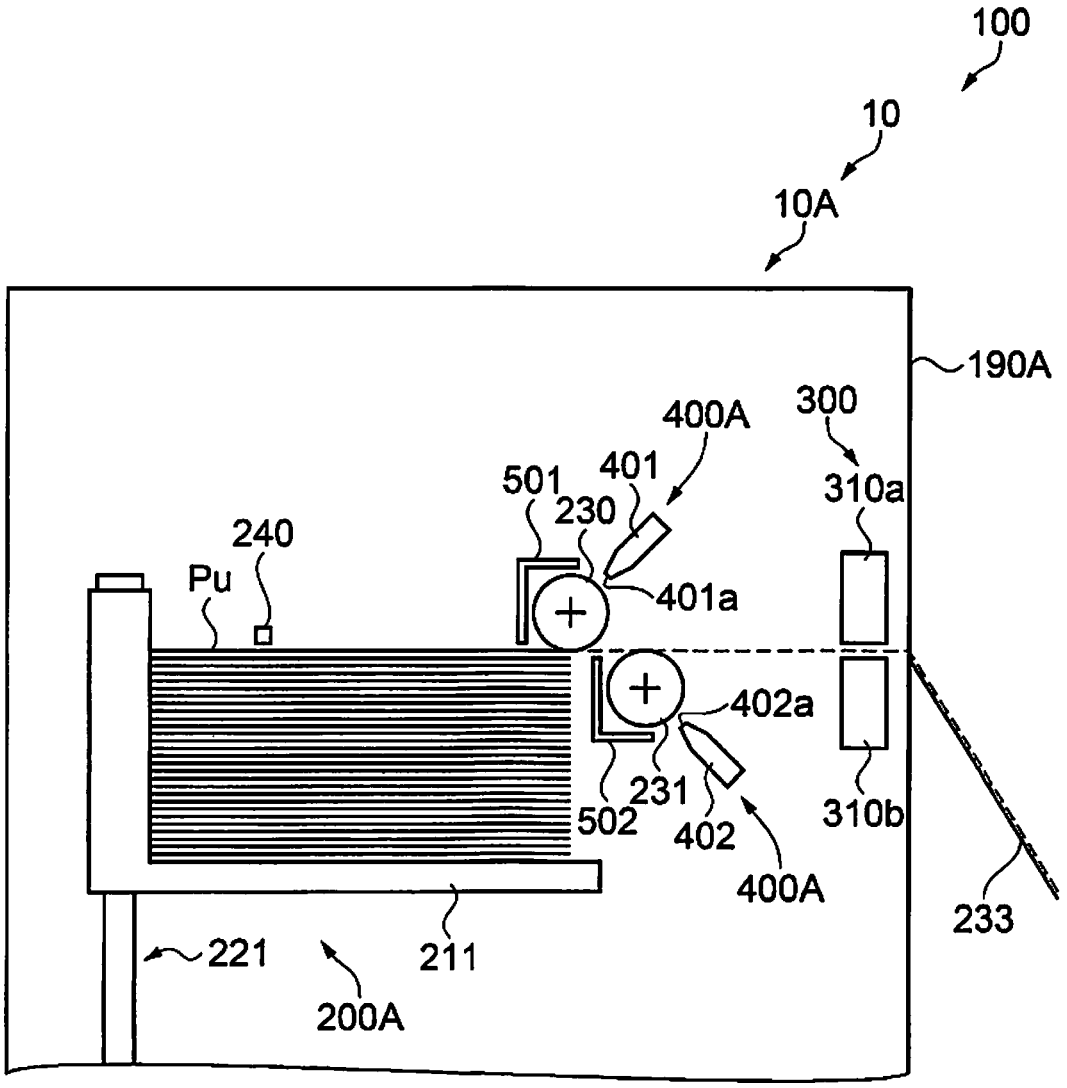
FIG. 2A is a schematic view showing a configuration of a used paper supply device (supply unit) according to the first embodiment.
Figure 2B:
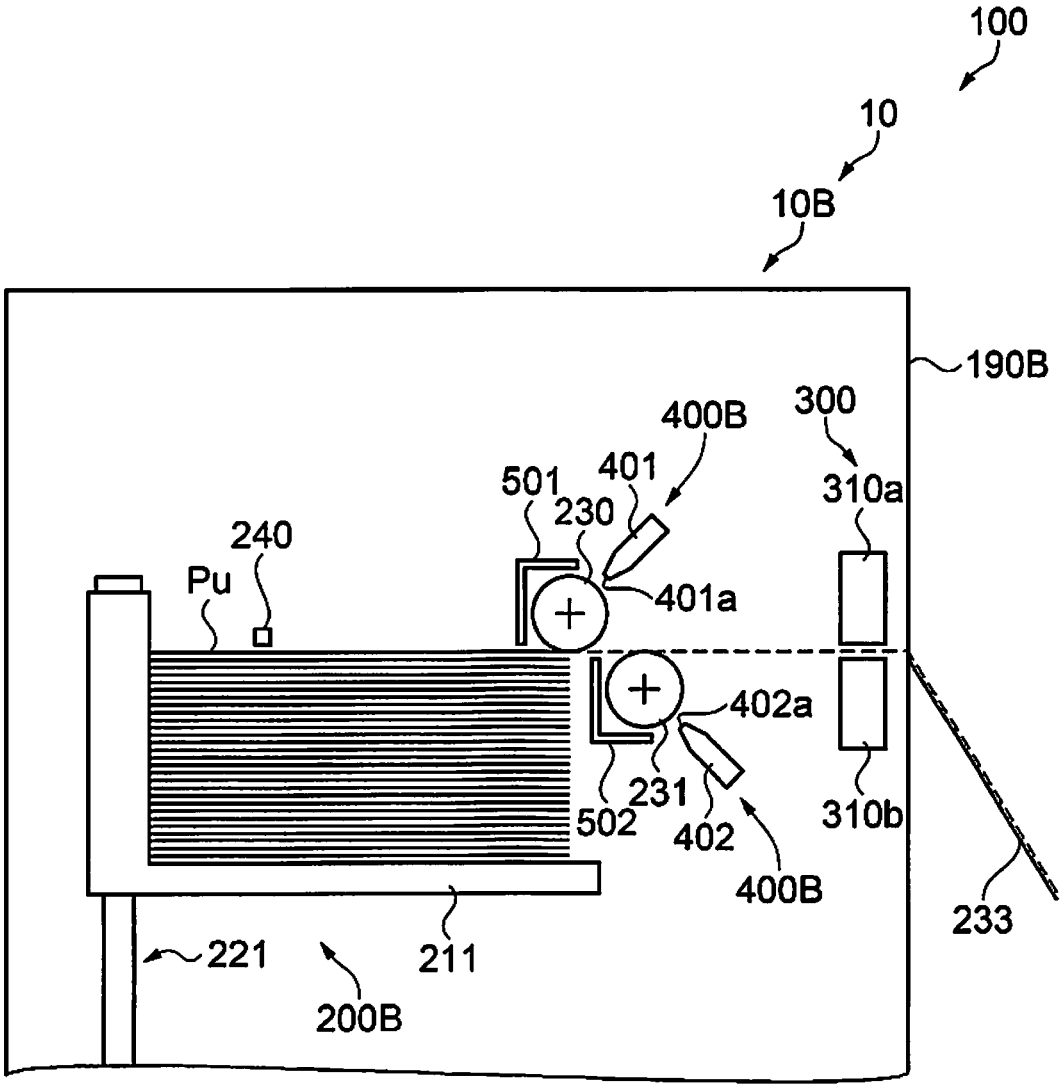
FIG. 2B is a schematic view showing the configuration of the used paper supply device (supply unit) according to the first embodiment.
Figure 3:
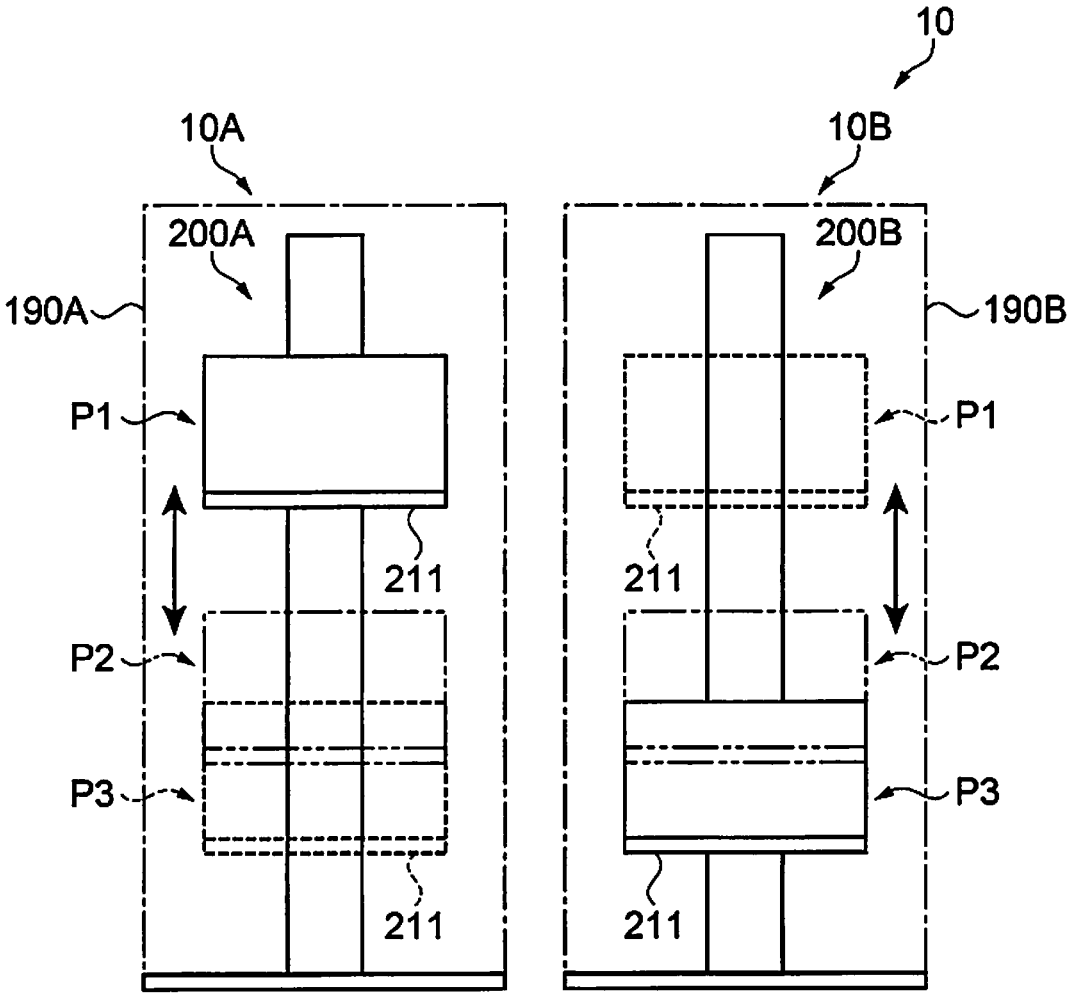
FIG. 3 is a schematic view showing the configuration of the used paper supply device (supply unit) according to the first embodiment.

Next, the detailed configuration of a supply unit (used paper supply device) will be described. FIGS. 2A, 2B, and 3 are schematic views showing a configuration of the supply unit according to the first embodiment.

A supply unit 10 of the present embodiment includes a first paper feed unit 200A and a second paper feed unit 200B for feeding used paper Pu and a first cleaning unit 400A and a second cleaning unit 400B for cleaning surfaces of rollers (a pickup roller 230 and a double feed prevention roller 231) of the paper feed units 200A and 200B.

In the present embodiment, for example, a case of supplying A4 size used paper Pu mainly used in the office or the like will be described.

The supply unit 10 of the present embodiment is configured of a first supply unit 10A and a second supply unit 10B. The first supply unit 10A includes the first paper feed unit 200A and the first cleaning unit 400A, and the second supply unit 10B includes the second paper feed unit 200B and the second cleaning unit 400B. Each part, unit, or the like in the supply unit 10 are drive-controlled by the controller 110 (refer FIG. 1). In addition, the configuration which provided the separate controller in the supply unit 10 may be provided.

Further, in the present embodiment, as illustrated in FIG. 3, the first supply unit 10A and the second supply unit 10B are disposed in parallel, and the used paper Pu can be supplied to the rough crushing unit 12 from each of the first supply unit 10A and the second supply unit 10B.

First, the configuration of the first supply unit 10A will be described. As illustrated in FIG. 2A, the first supply unit 10A includes the first paper feed unit 200A, the first cleaning unit 400A, and the like. The first supply unit 10A has a case 190A, and the first paper feed unit 200A and the first cleaning unit 400A are accommodated in the case 190A.

The first paper feed unit 200A of the first supply unit 10A includes a tray 211 for storing the used paper Pu and a moving mechanism 221 for moving the tray 211. The moving mechanism 221 is configured to be able to move the tray 211 in the vertical direction, as illustrated in FIG. 3. The moving mechanism 221 is configured of, for example, a ball screw mechanism or the like. By driving the moving mechanism 221, as illustrated in FIG. 3, the tray 211 can be moved between the paper feed position P1, a retracted position P2, and a home position P3.

Further, the first paper feed unit 200A includes a level sensor 240 above the tray 211, and the level sensor 240 detects the position (paper feed position P1) of the uppermost used paper Pu of the tray 211. The detection of the level sensor 240 makes it possible to move the tray 211 upward to the paper feed position P1 in the vertical direction, so that the paper feed position P1 can always be in constant. In addition, the moving mechanism 221 of the first paper feed unit 200A includes a rotary encoder (not illustrated), and the tray 211 is at a retracted position P2 vertically lower than the paper feed position P1, and further vertically than the retracted position P2. It is possible to move to the lower home position P3. As described later, the cleaning process of the first paper feed unit 200A is performed at the retracted position P2. In addition, at the home position P3, replenishment of the used paper Pu to the first paper feed unit 200A is performed. The retracted position P2 and the home position P3 may be at the same position.

The first paper feed unit 200A is provided with a roller for conveying the used paper Pu. Specifically, the pickup roller 230 is disposed at a position (paper feed position P1) corresponding to the uppermost used paper Pu stored in the tray 211, and the used paper Pu is fed out one by one. The used paper Pu fed by the pickup roller 230 is discharged (supplied) from the first supply unit 10A (supply unit 10) along the guide unit 233 disposed outside the case 190A.

In addition, a double feed prevention roller 231 is disposed downstream of the pickup roller 230 in the conveying direction of the used paper Pu. The double feed prevention roller 231 is a roller that rotates in the opposite direction (counterclockwise in FIG. 2A) to the pickup roller 230. Accordingly, for example, when the used paper Pu is fed out from the pickup roller 230 in an overlapping state, the conveyance of the used paper Pu in contact with the double feed prevention roller 231 to the downstream side in the conveying direction is restricted. Accordingly, the waste paper Pu can be prevented from double feeding.

The first cleaning unit 400A cleans the surfaces (surfaces in contact with the used paper Pu) of the pickup roller 230 and the double feed prevention roller 231 as the rollers of the first paper feed unit 200A. The first cleaning unit 400A of the present embodiment is, for example, a unit capable of discharging air compressed by a compressor or the like, and includes air discharge units 401 and 402 discharging the compressed air (air) in which a plurality of nozzles 401*a* and 402*b* are arranged.

In the present embodiment, the air discharge unit 401 corresponds to the pickup roller 230, and the nozzle 401*a* is disposed so as to face the surface of the pickup roller 230.

The air discharge unit 402 corresponds to the double feed prevention roller 231, and the nozzle 402*a* is disposed so as to face the surface of the double feed prevention roller 231. Further, the air discharge units 401 and 402 are arranged such that the plurality of nozzles 401*a* and 402*b* are arranged in parallel in a rotation axis direction of the rollers 230 and 231, respectively. Then, the air is discharged (sprayed) from the nozzle 401*a* toward the surface of the pickup roller 230, and air is discharged (sprayed) from the nozzle 402*a* toward the surface of the double feed prevention roller 231. It is possible to remove toner, ink, and other foreign substance such as paper dust adhering to the surface of the pickup roller 230 and the double feed prevention roller 231.

Further, covers 501 and 502 covering the respective rollers are provided in the vicinity and on the upstream side of the respective rollers (the pickup roller 230 and the double feed prevention roller 231). The cover 501 is provided corresponding to the pickup roller 230. Specifically, the cover 501 is provided on the upstream side of the pickup roller 230 in the paper feed direction. Further, the cover 501 is configured by a plate portion that covers the upper side and the side portion on the upstream side of the pickup roller 230 in the paper feed direction. In other words, the cover 501 functions as a partition wall (wall) that partitions the pickup roller 230 and the used paper Pu placed on the tray 211. Accordingly, when the air is blown toward the pickup roller 230 by the air discharge unit 401, foreign substance such as paper dust removed from the pickup roller 230 collides with the cover 501, thereby preventing foreign substance from adhering to the used paper Pu.

The cover 502 is provided corresponding to the double feed prevention roller 231. Specifically, the cover 502 is provided on the upstream side of the double feed prevention roller 231 in the paper feed direction. Further, the cover 502 is configured by a plate portion that covers the side portion and the lower portion on the upstream side of the double feed prevention roller 231 in the paper feed direction. In other words, the cover 502 functions as a partition wall (barrier) that separates the double feed prevention roller 231 and the used paper Pu placed on the tray 211. Thereby, when the air is blown toward the double feed prevention roller 231 by the air discharge unit 402, foreign substance such as paper dust removed from the double feed prevention roller 231 collides with the cover 502, it is possible to prevent foreign substance from adhering to the used paper Pu.

The first supply unit 10A is provided with a detection unit 300. The detection unit 300 is, for example, a photo-interrupter, and includes a light emission unit 310*a* that emits light and a light receiving unit 310*b* that receives the light emitted from the light emission unit 310*a*. For example, a light emitting diode (LED) light emitting element, a laser light emitting element, or the like is applied as a light emitting element of the light emission unit 310*a*. The light receiving unit 310 *b* is configured by a phototransistor, a photo IC, or the like. By detecting the presence or absence of used paper Pu (on the light path of the detection unit 300) between the light emission unit 310*a* and the light receiving unit 310*b*, it is possible to measure the number of papers of used paper Pu fed.

Next, the configuration of the second supply unit 10B will be described. As illustrated in FIG. 2B, the second supply unit 10B includes the second paper feed unit 200B, the second cleaning unit 400B, and the like. The second supply unit 10B has a case 190B, and the second paper feed unit 200B and the second cleaning unit 400B are accommodated in the case 190B. In addition, the configuration of the second supply unit 10B is the same as the configuration of the first supply unit 10A, so the description will be omitted.

The first supply unit 10A and the second supply unit 10B may be integrated. That is, the first paper feed unit 200A and the first cleaning unit 400A, and the second paper feed unit 200B and the second cleaning unit 400B may be disposed in one case.

Figure 4:
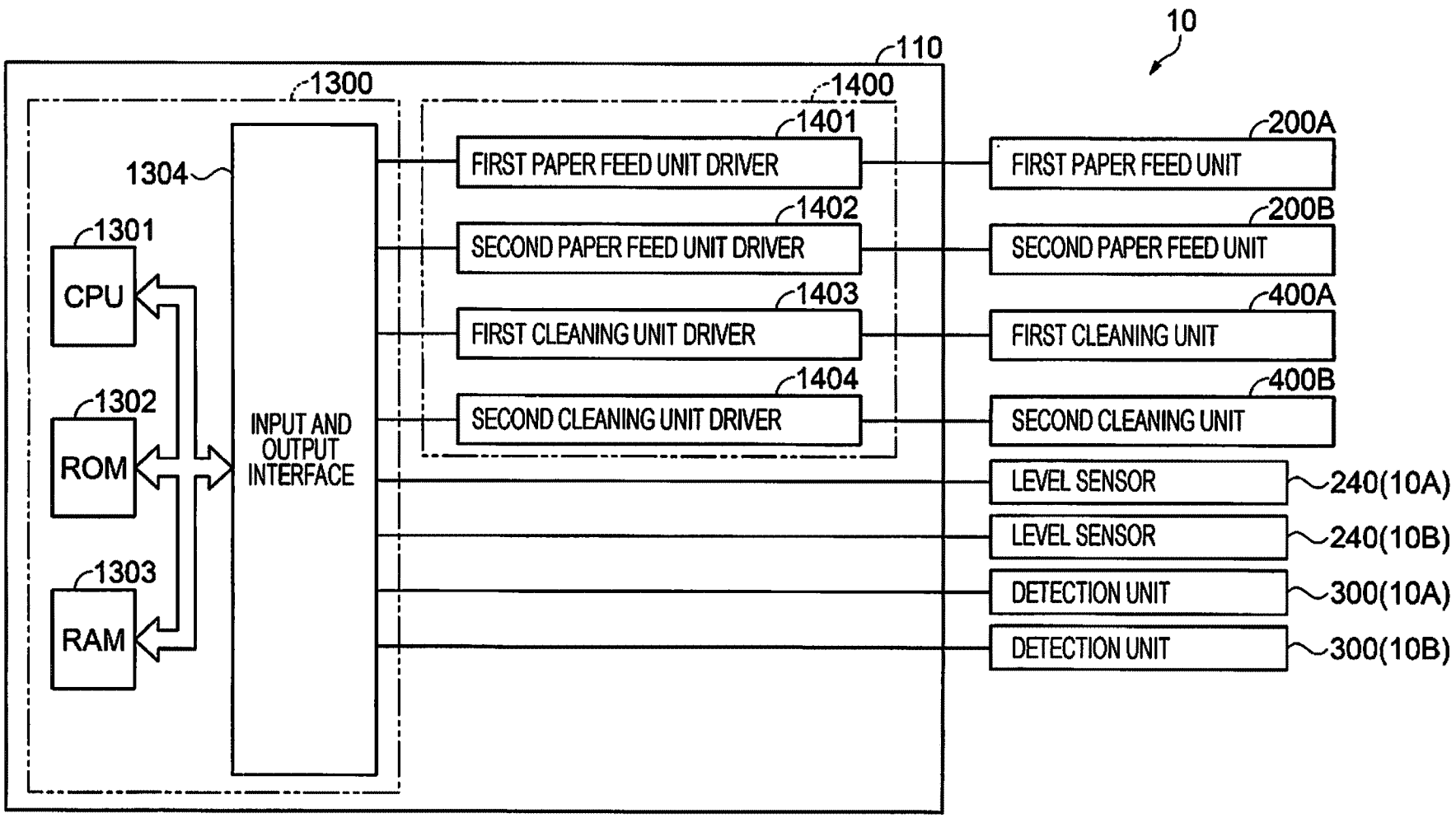
FIG. 4 is a block diagram showing the configuration of a controller of the used paper supply device (supply unit) according to the first embodiment.

Next, the configuration of the controller of the supply unit (used paper supply device) will be described. FIG. 4 is a block diagram showing the configuration of a controller of the supply unit. As illustrated in FIG. 4, the controller 110 includes a command unit 1300 and a driving unit 1400. The command unit 1300 includes a CPU 1301, a ROM 1302 as a storage unit, a RAM 1303, and an input and output interface 1304. The CPU 1301 processes various signals input via the input and output interface 1304 based on data in the ROM 1302 and the RAM 1303. The control signal is output to the driving unit 1400 via the input and output interface 1304. The CPU 1301 performs various controls based on, for example, a control program stored in the ROM 1302.

The driving unit 1400 includes a first paper feed unit driver 1401, a second paper feed unit driver 1402, a first cleaning unit driver 1403, and a second cleaning unit driver 1404. In addition, each of the level sensor 240 and the detection unit 300 is connected to the command unit 1300, and the command unit 1300 calculates in accordance with the input data from the level sensor 240 and the detection unit 300 and transmits a drive signal to the driving unit 1400. Based on the control signal of the command unit 1300, the first paper feed unit driver 1401 controls driving of the first paper feed unit 200A, and the second paper feed unit driver 1402 controls drive of the second paper feed unit 200B. The first cleaning unit driver 1403 controls driving of the first cleaning unit 400A, and the second cleaning unit driver 1404 controls driving of the second cleaning unit 400B.

Figure 5:
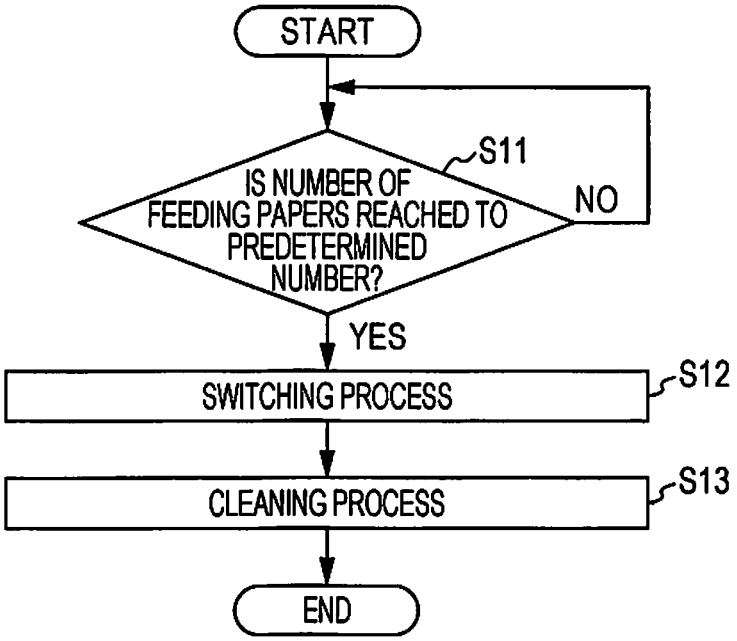
FIG. 5 is a flowchart showing a control method of the used paper supply device (supply unit) according to the first embodiment.
Figure 6:
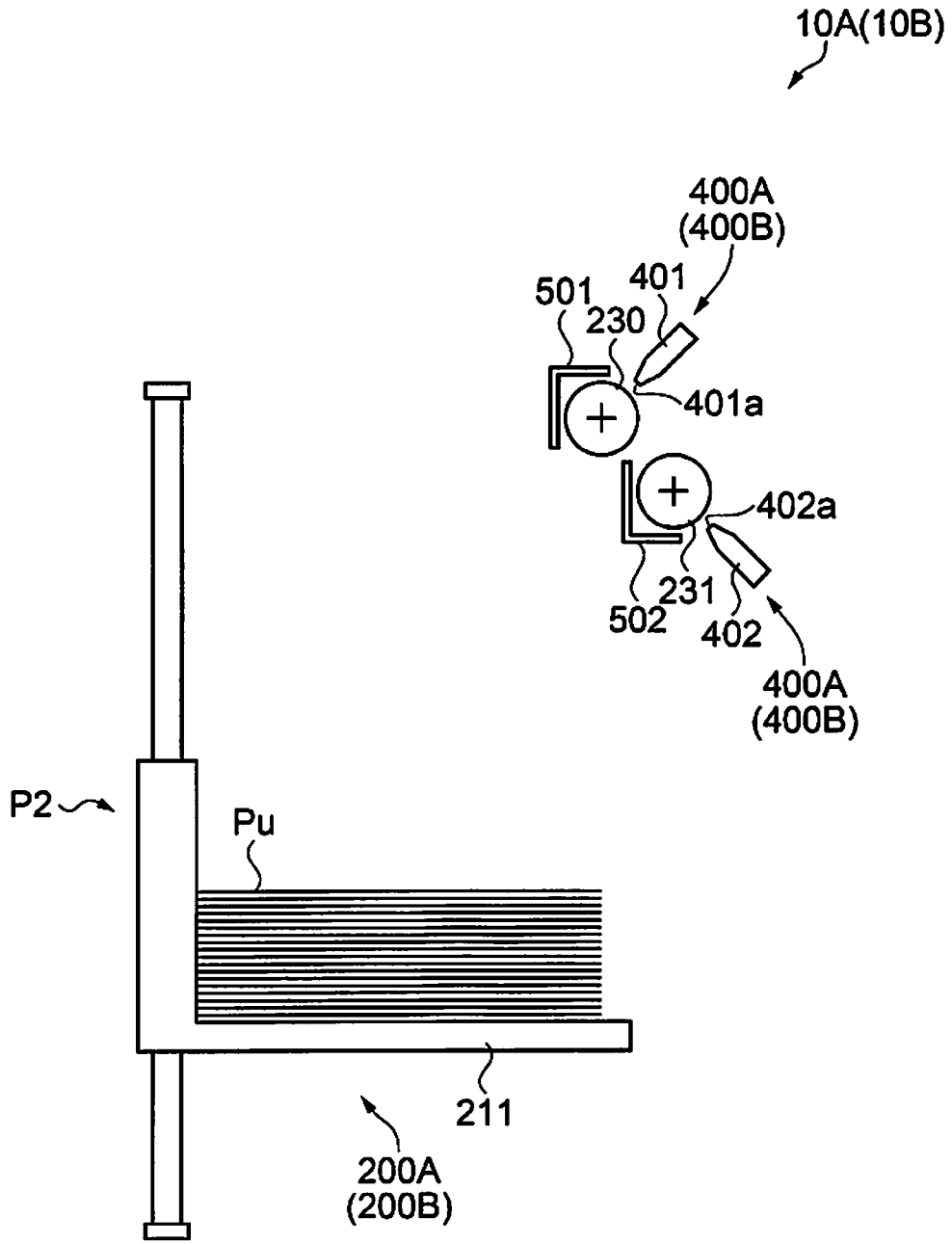
FIG. 6 is a schematic view showing a cleaning operation of the used paper supply device (supply unit) according to the first embodiment.

Next, a control method of the supply unit (used paper supply device) will be described. FIG. 5 is a flowchart showing the control method of the supply unit according to the present embodiment, FIG. 6 is a schematic view showing the cleaning operation of the supply unit, and FIG. 7 is an explanatory view showing the switching operation of the supply unit.

In the supply unit 10 of the present embodiment, when the used paper Pu is fed from the first paper feed unit 200A, the surface of the roller (the pickup roller 230 and the double feed prevention roller 231) of the second paper feed unit 200B is cleaned. In addition, the surface of the roller (pickup roller 230, double feed prevention roller 231) is cleaned every time a predetermined number of papers are fed. The details will be described below.

The used paper Pu is fed from the first paper feed unit 200A of the first supply unit 10A.

Figure 7:
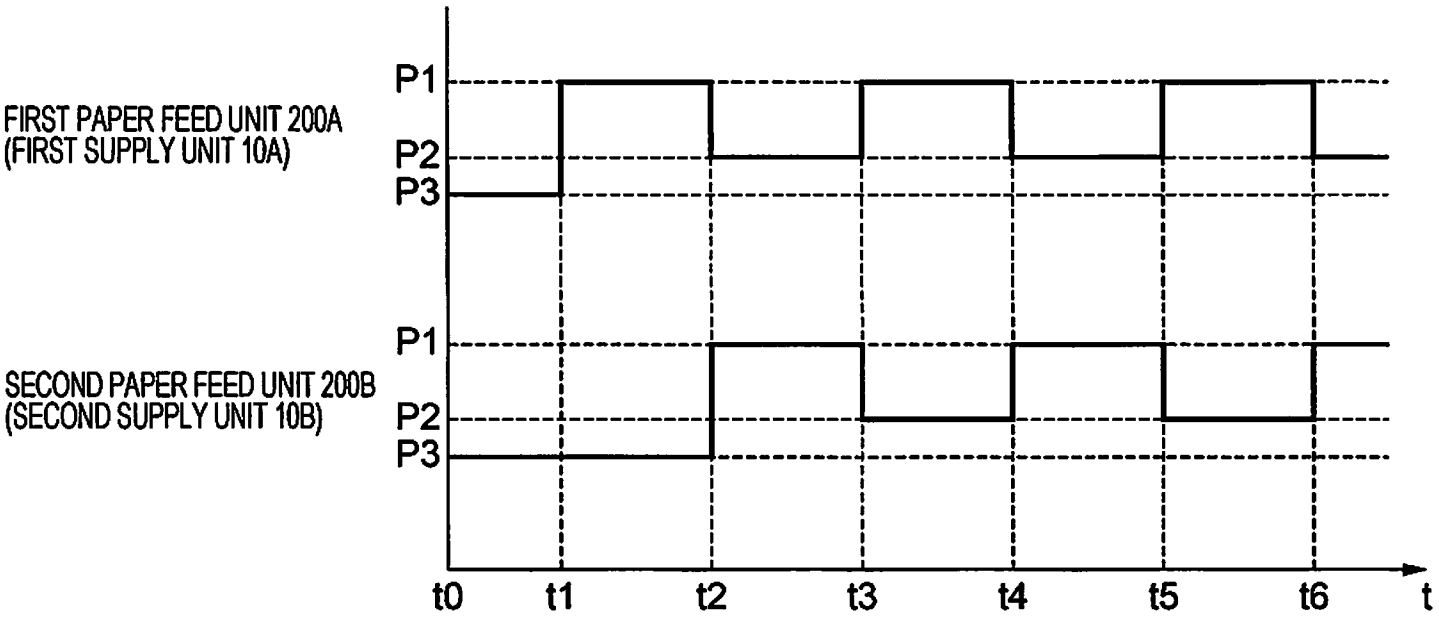
FIG. 7 is an explanatory view showing a switching operation of the used paper supply device (supply unit) according to the first embodiment.

As illustrated at time t1 in FIG. 7, the tray 211 of the first paper feed unit 200A is moved to the paper feed position P1, and the pickup roller 230 and the double feed prevention roller 231 are driven to feed the used paper Pu.

At this time, the tray 211 of the second paper feed unit 200B of the second supply unit 10B is moved to the home position P3. At the home position P3, the user can replenish the used paper Pu to the tray 211 of the second supply unit 10B. At this time, the pickup roller 230 and the double feed prevention roller 231 of the second supply unit 10B may be cleaned.

Then, it is determined whether or not the number of fed papers of used paper Pu in the paper feed unit 200A is reached a predetermined number (step S11). The number of fed papers in the paper feed unit 200A is detected by the detection unit 300.

For the predetermined number of papers, the number of papers to be fed in which a transfer error of the used paper Pu occurs by the pickup roller 230 or the double feed prevention roller 231 is obtained in advance by experiment or the like and the number of papers is set smaller than the number of papers fed. In this manner, it is possible to prevent conveyance errors in the paper feed unit 200A in advance.

The predetermined number of papers may be set by the user (for example, the predetermined number may be set to 50 papers or 100 papers when the limit of the number of papers accommodated in the tray 211 is 300 papers).

When the number of fed papers of used paper Pu reaches a predetermined number (S11; YES), the process proceeds to step S12 and when the number of papers fed of the used paper Pu is not reached the predetermined number (S11; NO), the feeding by the first supply unit 10A is continuously performed.

Next, in order to shift to the cleaning process of the pickup roller 230 and the double feed prevention roller 231 of the paper feed unit 200A, the switching process between the first supply unit 10A and the second supply unit 10B is executed (step S12).

In this case, as illustrated at time t2 in FIG. 7, the tray 211 of the first supply unit 10A is moved from the paper feed position P1 to the retracted position P2. On the other hand, the tray 211 of the second supply unit 10B is moved from the home position P3 to the paper supply position P1, and the pickup roller 230 and the double feed prevention roller 231 of the second supply unit 10B are driven to perform paper supply processing of used paper Pu.

In parallel with the paper feeding process by the second supply unit 10B, the cleaning process of the first supply unit 10A is executed (step S13).

Specifically, as illustrated in FIG. 6, in a state where the tray 211 positioned at the retracted position P2, the cleaning unit 400A is driven and air is sprayed from the nozzles 401*a* and 402*a* of the air discharge units 401 and 402 toward the surfaces of the pickup roller 230 and the double feed prevention roller 231. Therefore, foreign substance such as paper dust adhering to the surfaces of the pickup roller 230 and the double feed prevention roller 231 is removed. In addition, since the covers 501 and 502 are disposed corresponding to the pickup roller 230 and the double feed prevention roller 231, the foreign substances and the like removed from the pickup roller 230 and the double feed prevention roller 231 are blocked by the covers 501 and 502, and do not adhere to the used paper Pu accommodated in the tray 211. Furthermore, since during the cleaning process, the tray 211 is moved to the retracted position P2, and the tray 211 is farther from the pickup roller 230 and the double feed prevention roller 231 than the paper feed position P1, it is possible to prevent the removed foreign substance adhering to the used paper Pu.

After the cleaning process is completed, the tray 211 may be moved from the retracted position P2 to the home position P3. Accordingly, the user can replenish the tray 211 with used paper Pu.

In a case where the number of papers of used paper Pu fed in the paper feed unit 200B reaches a predetermined number, the paper feeding process is switched by the paper feed unit 200A by switching to the first supply unit 10A. The predetermined number of papers in the paper feed unit 200B is detected by the detection unit 300.

Specifically, as illustrated at time t3 in FIG. 7, the tray 211 of the second supply unit 10B is moved from the paper feed position P1 to the retracted position P2. On the other hand, the tray 211 of the first supply unit 10A is moved from the retracted position P2 to the paper supply position P1, and the pickup roller 230 and the double feed prevention roller 231 of the first supply unit 10A drive the used paper Pu. Here, since the pickup roller 230 and the double feed prevention roller 231 of the first supply unit 10A are subjected to the cleaning process, the conveying of the used paper Pu is good.

Thereafter, as illustrated by t4, t5, . . . in FIG. 7, the first supply unit 10A and the second supply unit 10B are controlled such that the other supply unit performs the cleaning process while the one supply unit performs the paper supply process.

In a case where an error such as a jam occurs, the paper can be switched to the other supply unit to continue the paper feeding, and an error release procedure can be performed during that time to return.

As described above, according to this embodiment, the following effects can be obtained.

The cleaning process of the pickup roller 230 and the double feed prevention roller 231 of the first paper feed unit 200A and the cleaning process of the pickup roller 230 and the double feed prevention roller 231 of the second paper feed unit 200B are alternately executed. That is, when the first paper feed unit 200A is in the paper feeding state, the pickup roller 230 and the double feed prevention roller 231 of the second paper feed unit 200B are cleaned. In addition, when the second paper feed unit 200B is in the paper feeding state, the pickup roller 230 and the double feed prevention roller 231 of the first paper feed unit 200A are cleaned. Either one of the pickup roller 230 and the double feed prevention roller 231 may be cleaned, and preferably the pickup roller 230 is cleaned. Accordingly, it is possible to suppress the occurrence of a paper feeding error caused by the contamination or the like of the surfaces of the pickup roller 230 and the double feed prevention roller 231 of the first paper feed unit 200A and the second paper feed unit 200B. Therefore, the operation rate of the supply unit 10 can be increased.

Second Embodiment

Figure 8:
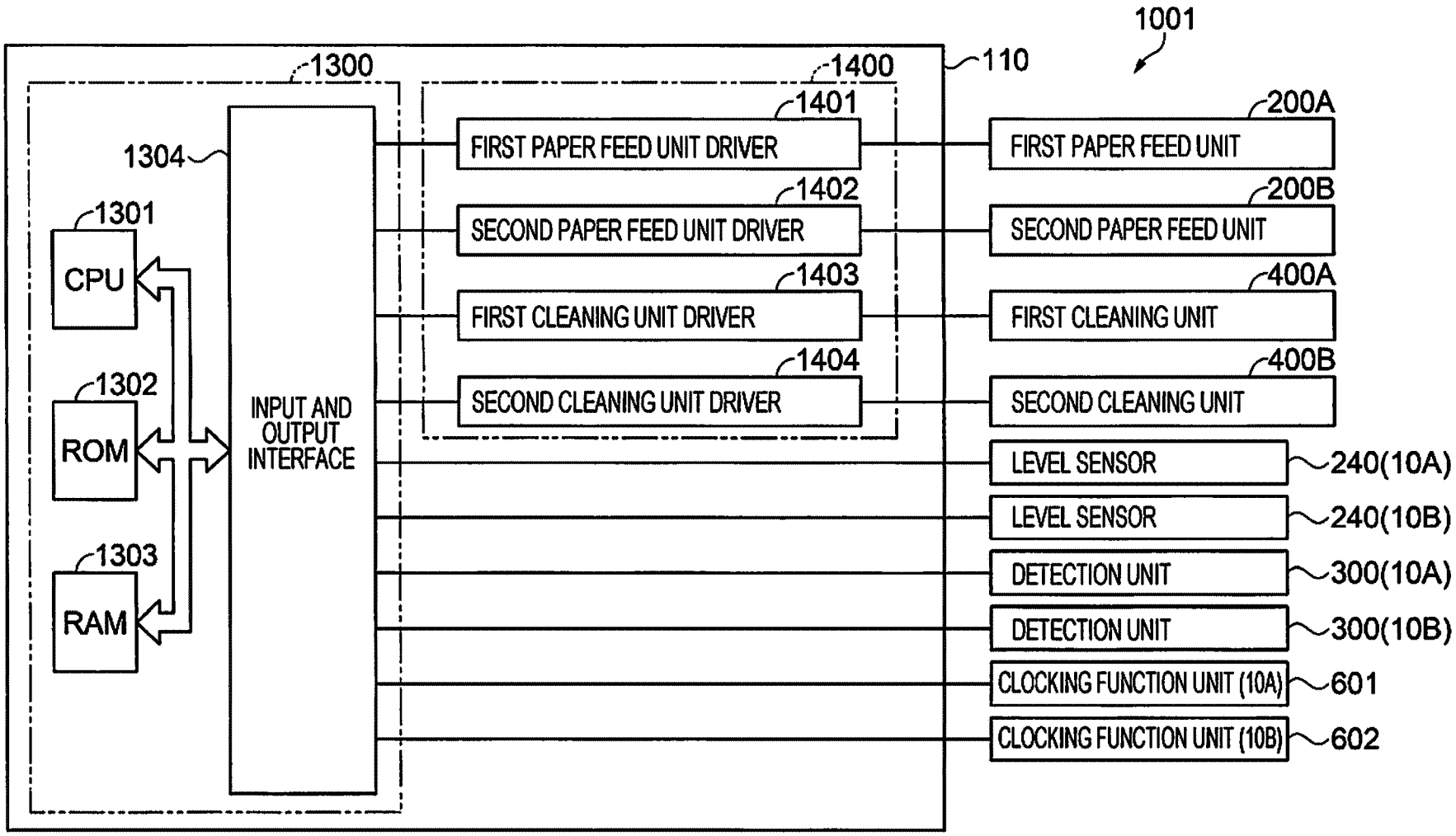
FIG. 8 is a block diagram showing a configuration of a controller of the used paper supply device (supply unit) according to a second embodiment.

Next, the second embodiment will be described. FIG. 8 is a block diagram showing a configuration of a controller of the supply unit according to a second embodiment.

As illustrated in FIG. 8, the supply unit 1000 of the present embodiment includes a first supply unit 10A and a second supply unit 10B. Clocking function units 601 and 602 are provided in each of the first supply unit 10A and the second supply unit 10B. The clocking function units 601 and 602 are connected to the command unit 1300. The clocking function units 601 and 602 have a stopwatch function capable of measuring time, a calendar function capable of measuring date and time, and the like.

The configuration other than the clocking function units 601 and 602 in the supply unit 1000 is the same as that of the first embodiment, and thus the description thereof is omitted.

Figure 9:
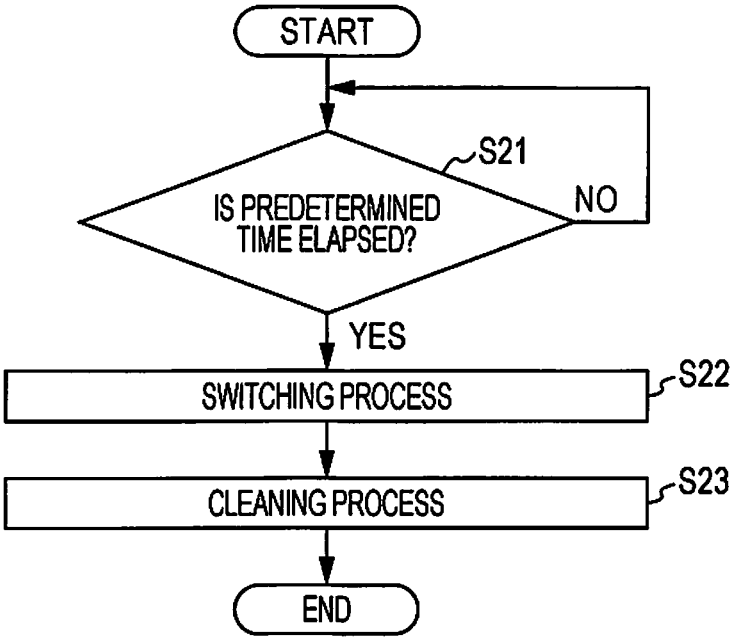
FIG. 9 is a flowchart showing a control method of the used paper supply device (supply unit) according to the second embodiment.

Next, a control method of the supply unit will be described. FIG. 9 is a flowchart showing a control method of the supply unit according to the present embodiment.

The supply unit 1000 of the present embodiment cleans the surfaces of the pickup roller 230 and the double feed prevention roller 231 of the first paper feed unit 200A every time when the first paper feed unit 200A is in the paper feeding state has passed a predetermined time. Similarly, the surface of the pickup roller 230 and the double feed prevention roller 231 of the second paper feed unit 200B is cleaned every time a predetermined time passes while the second paper feed unit 200B is in the paper feeding state. As described above, the timing at which the supply unit 10A and the supply unit 10B are switched is the paper feed amount in the first embodiment. However, it is different in the second embodiment in the continuation time of the paper feeding state. Hereinafter, it will be described in detail with reference to FIGS. 6, 7, 9.

As illustrated at time t1 in FIG. 7, the tray 211 of the first paper feed unit 200A is moved to the paper feed position P1, and the pickup roller 230 and the double feed prevention roller 231 are driven to feed the used paper Pu.

Then, it is determined whether or not the paper feeding state of the used paper Pu by the paper feed unit 200A has passed a predetermined time (step S21). The predetermined time in the paper feed unit 200A is measured by the clocking function unit 601.

As the predetermined time, a paper feeding time at which a transfer error of the used paper Pu occurs by the pickup roller 230 or the double feed prevention roller 231 is obtained in advance by experiment or the like, and is set to a time shorter than the paper feeding time. In this manner, it is possible to prevent conveyance errors in the paper feed unit 200A in advance.

The setting of the predetermined time may be set by the user (for example, 15 minutes or 30 minutes).

In a case where the paper feed time for used paper Pu is passed a predetermined time (S21; YES), the process proceeds to step $22, and if the paper feed time for used paper Pu is not passed a predetermined time (S21; NO), the paper feeding by the first supply unit 10A is continuously performed.

Subsequently, in order to shift to the cleaning process of the pickup roller 230 and the double feed prevention roller 231 of the paper feed unit 200A, the switching process of the first supply unit 10A and the second supply unit 10B is executed (step S22).

In this case, as illustrated at time t2 in FIG. 7, the tray 211 of the first supply unit 10A is moved from the paper feed position P1 to the retracted position P2. On the other hand, the tray 211 of the second supply unit 10B is moved from the home position to the paper supply position P1, and the pickup roller 230 and the double feed prevention roller 231 of the second supply unit 10B drive the used paper Pu.

In parallel with the paper feeding process by the second supply unit 10B, the cleaning process of the first supply unit 10A is executed (step S23). The details of the cleaning process are the same as in the first embodiment.

When the paper feed time of the used paper Pu in the paper feed unit 200B reaches a predetermined time, the paper supply process is switched to the first supply unit 10A and the paper feed unit 200A performs the paper feed process. The predetermined time in the paper feed unit 200B is measured by the clocking function unit 602.

Thereafter, as illustrated by t4, t5, . . . in FIG. 7, the first supply unit 10A and the second supply unit 10B are controlled such that the other supply unit performs the cleaning process while the one supply unit performs the paper supply process.

As described above, according to this embodiment, the following effects can be obtained.

The first paper feed unit 200A and the second paper feed unit 200B are switched at regular time intervals, and the surfaces of the pickup roller 230 and the double feed prevention roller 231 which are not in the paper feeding state are cleaned. Accordingly, the paper feeding error can be suppressed.

Third Embodiment

Next, a third embodiment will be described.

Figure 10:
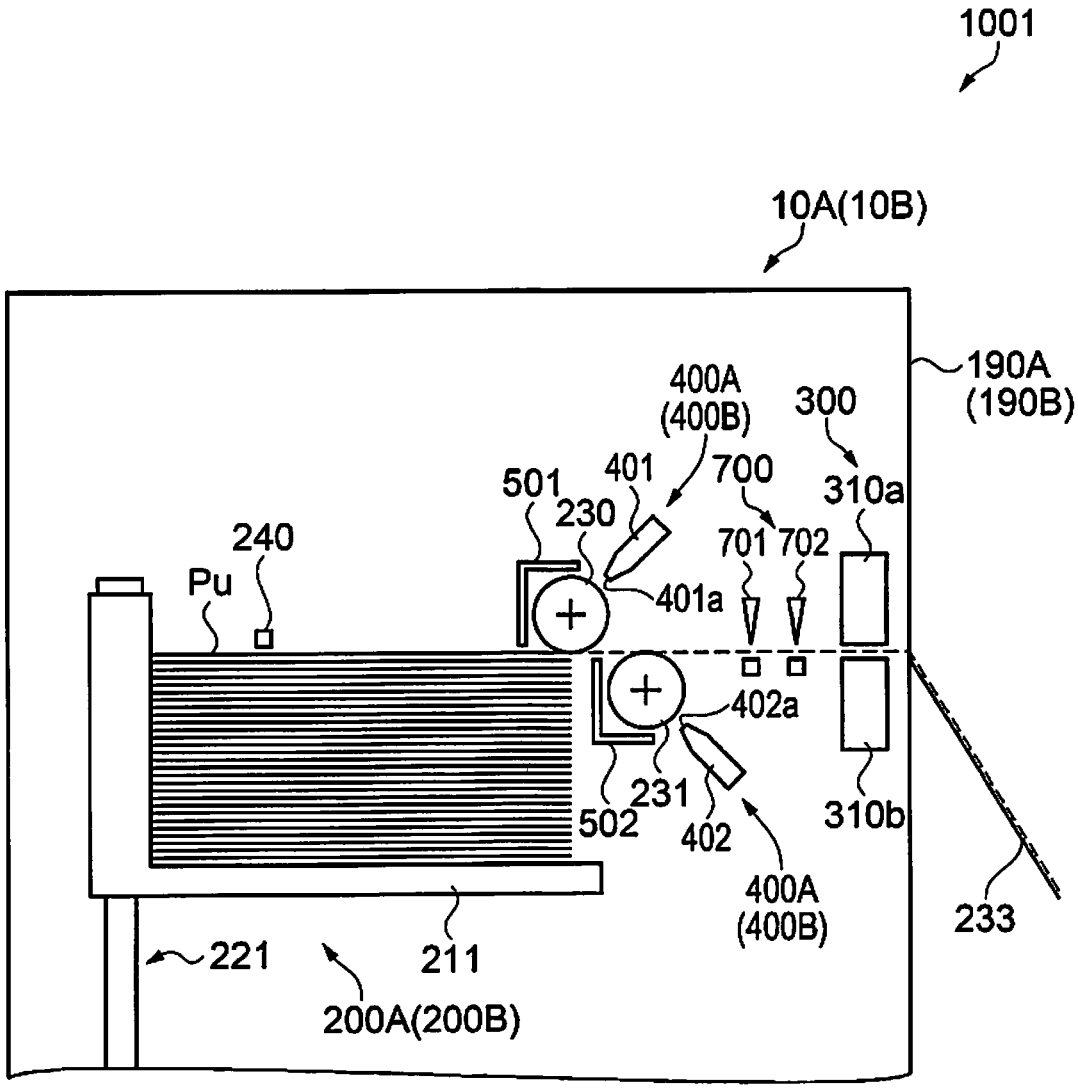
FIG. 10 is a schematic view showing a configuration of a used paper supply device (supply unit) according to a third embodiment.
Figure 11:
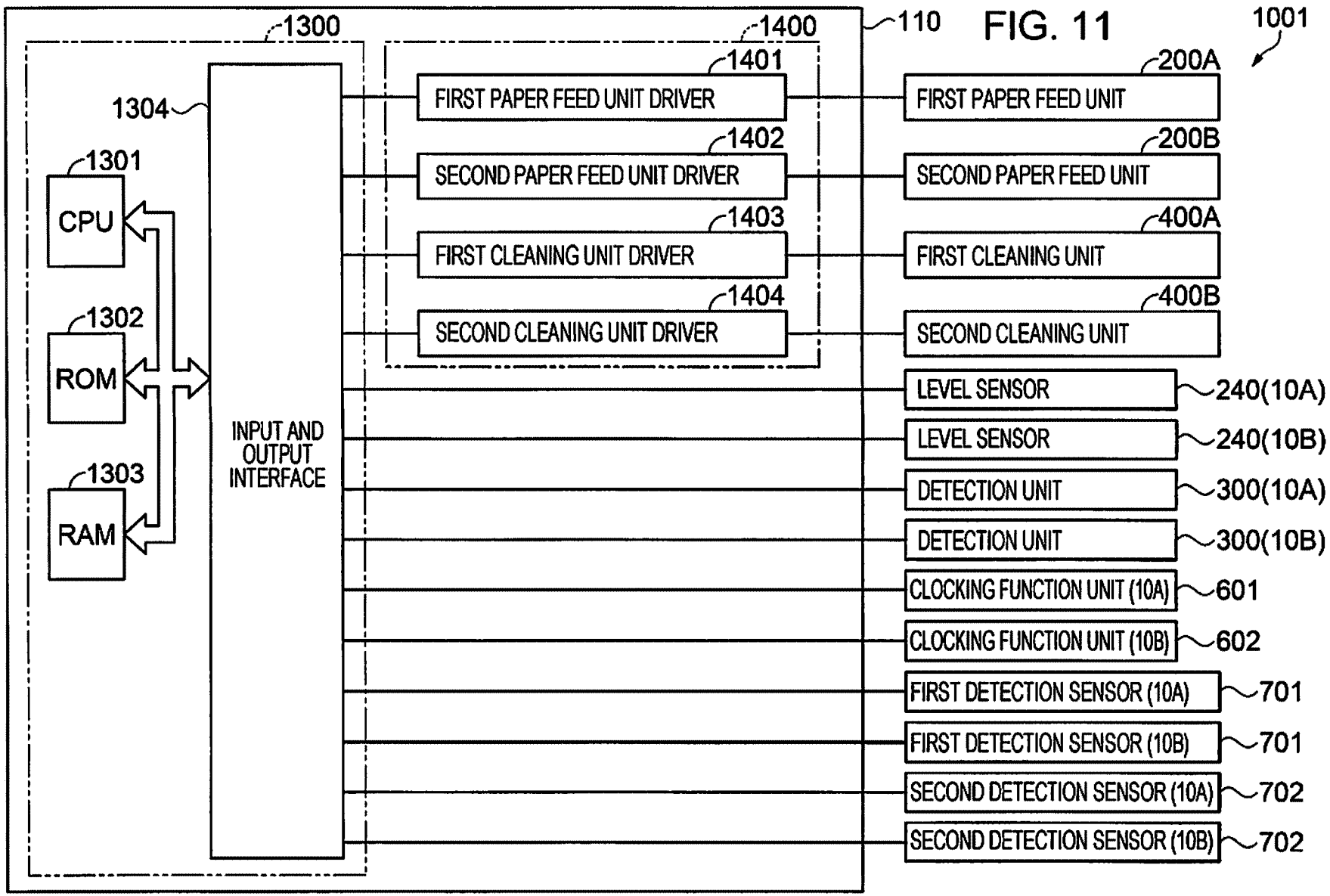
FIG. 11 is a block diagram showing a configuration of a controller of the used paper supply device (supply unit) according to the third embodiment.

First, the configuration of the supply unit according to the present embodiment will be described. FIG. 10 is a schematic view showing the configuration of the supply unit according to the present embodiment. Moreover, FIG. 11 is a block diagram which shows a structure of the controller of the supply unit according to the present embodiment.

As illustrated in FIG. 10, the supply unit 1001 includes a detection sensor 700 as a prediction unit that predicts when to clean the surfaces of the pickup roller 230 and the double feed prevention roller 231 of the first paper feed unit 200A and the second paper feed unit 200B.

The detection sensor 700 includes a first detection sensor 701 and a second detection sensor 702. The first detection sensor 701 and the second detection sensor 702 are, for example, photo interrupters.

The first detection sensor 701 and the second detection sensor 702 are disposed on the paper feeding (conveying) channel of the used paper Pu. The first detection sensor 701 is disposed downstream of the double feed prevention roller 231 in the conveying direction of the used paper Pu and the second detection sensor 702 is disposed adjacent to the downstream side of the first detection sensor 701 in the conveying direction of used paper Pu.

The first detection sensor 701 and the second detection sensor 702 are connected to the command unit 1300, respectively.

The first detection sensor 701 and the second detection sensor 702 cooperate with the clocking function units 601 and 602 to detect the conveyance time of used paper Pu between the first detection sensor 701 and the second detection sensor 702. Specifically, each of the first detection sensor 701 and the second detection sensor 702 detects the presence or absence of passage of the end portion on the downstream side of the used paper Pu to be conveyed, and the clocking function units 601 and 602 detect the conveyance time of used paper Pu between the first detection sensor 701 and the second detection sensor 702 based on the detection of the first detection sensor 701 and the second detection sensor 702. For example, when the surfaces of the pickup roller 230 and the double feed prevention roller 231 become dirty, the used paper Pu to be conveyed tends to slip, and the time for passing from the first detection sensor 701 to the second detection sensor 702 tends to be long. For this reason, based on the conveyance time of the used paper Pu between the first detection sensor 701 and the second detection sensor 702, the time to be cleaned is predicted.

The configuration other than the first detection sensor 701 and the second detection sensor 702 in the supply unit 1001 is the same as in the first and second embodiments, and thus the description thereof is omitted.

Figure 12:
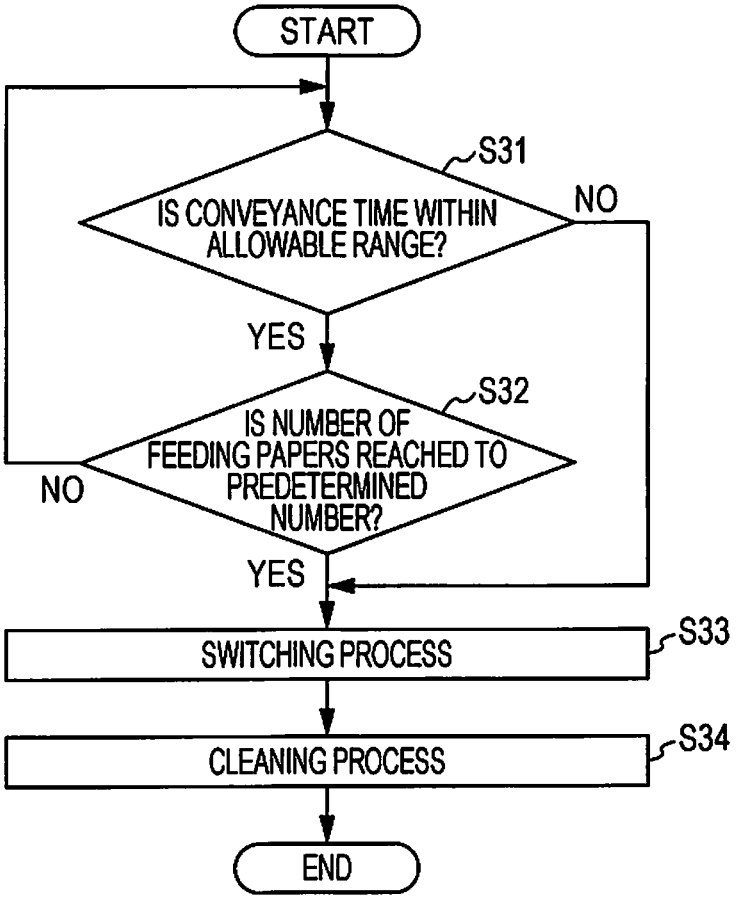
FIG. 12 is a flowchart showing a control method of the used paper supply device (supply unit) according to the third embodiment.

Next, a control method of the supply unit 1001 will be described. FIG. 12 is a flowchart showing a control method of the supply unit according to the present embodiment.

The supply unit 1001 according to the present embodiment performs cleaning in accordance with the conveyance time (conveyance speed) of the used paper Pu to be fed. In the present embodiment, a configuration in the case where the cleaning process by the conveyance time (conveyance speed) of the used paper Pu to be fed and the cleaning process by the number of the used paper Pu to be fed are used in combination will be described with reference to FIGS. 7 and 12.

As illustrated at time t1 in FIG. 7, the tray 211 of the first paper feed unit 200A is moved to the paper feed position P1, and the pickup roller 230 and the double feed prevention roller 231 are driven to feed the used paper Pu.

It is determined whether the conveyance time of the used paper Pu by the paper feed unit 200A is within an allowable range (step S31). The conveyance time of the used paper Pu is measured by the cooperation of the first and second detection sensors 701 and 702 and the clocking function units 601 and 602.

The allowable time of the conveyance time of the used paper Pu is obtained in advance by experiments or the like to determine the conveyance time at which a conveyance error occurs, and is set to a time shorter than the conveyance time. In this manner, it is possible to prevent conveyance errors in the paper feed unit 200A in advance.

In addition, the setting of the allowable time of the conveyance time of the used paper Pu may be set by the user.

Then, in a case where the conveyance time of the used paper Pu is within the allowable range (S31; YES), the process proceeds to step S32, and in a case where the conveyance time of the used paper Pu is outside the allowable range (S31; NO), the process proceeds to step S33.

In a case where the process proceeds to step S33, the process of switching between the first supply unit 10A and the second supply unit 10B is performed to shift to the cleaning process of the pickup roller 230 and the double feed prevention roller 231 of the paper feed unit 200A.

In this case, as illustrated at time t2 in FIG. 7, the tray 211 of the first supply unit 10A is moved from the paper feed position P1 to the retracted position P2. On the other hand, the tray 211 of the second supply unit 10B is moved from the home position P3 to the paper supply position P1, and the pickup roller 230 and the double feed prevention roller 231 of the second supply unit 10B are driven to perform paper supply processing of used paper Pu.

In parallel with the paper feeding process by the second supply unit 10B, the cleaning process of the first supply unit 10A is executed (step S34). The details of the cleaning process are the same as in the first embodiment.

When the process proceeds to step S32, it is determined whether the number of papers of used paper Pu fed in the paper feed unit 200A has reached a predetermined number. The setting of the predetermined number of papers is the same as that of the first embodiment.

Then, in a case where the number of fed papers of the used paper Pu reaches a predetermined number (S32; YES), the process proceeds to step S33, and after the switching process is performed as described above (step S33), the cleaning process is performed (step S34). On the other hand, when the number of papers fed of the used paper Pu has not reached the predetermined number (S32; NO), the paper feeding by the first supply unit 10A is continuously performed.

Thereafter, as illustrated by t4, t5, . . . in FIG. 7, the first supply unit 10A and the second supply unit 10B are controlled such that the other supply unit performs the cleaning process while the one supply unit performs the paper supply process.

As described above, according to this embodiment, the following effects can be obtained.

According to the conveyance time (speed) of the used paper Pu to be fed, since the time to be cleaned is predicted, it is possible to switch between the first paper feed unit 200A and the second paper feed unit 200B before a paper feeding error occurs. Accordingly, the paper feeding error can be suppressed.

The present invention is not limited to the above-described embodiment, and various modifications, improvements, and the like can be added to the above-described embodiment. A modification example will be described below.

Modification Example 1

In the first embodiment, the surface of the pickup roller 230 and the double feed prevention roller 231 is cleaned each time a predetermined number of papers are fed. However, the present invention is not limited to this configuration. For example, the surface of the pickup roller 230 and the double feed prevention roller 231 may be cleaned each time the paper feeding for a predetermined length is performed.

In this case, the total length can be calculated by integrating the length of the used paper Pu per paper in the conveying direction with respect to the number of used paper Pu detected by the detection unit 300.

Even in this case, it is possible to suppress the occurrence of a paper feeding error in the supply unit 10 and to increase the operation rate of the supply unit 10.

Modification Example 2

In the first embodiment, the surface of the pickup roller 230 and the double feed prevention roller 231 is cleaned each time a predetermined number of papers are fed. However, the present invention is not limited to this configuration. For example, the surface of the pickup roller 230 and the double feed prevention roller 231 may be cleaned each time a predetermined weight of paper is fed. In this case, for example, the load cell may be disposed in the portion of the tray 211 where the used paper Pu is placed.

Even in this case, it is possible to suppress the occurrence of a paper feeding error in the supply unit 10 and to increase the operation rate of the supply unit 10.

Modification Example 3

In the first embodiment, every time a predetermined number of papers are fed every 50 papers or every 100 papers, the surfaces of the pickup roller 230 and the double feed prevention roller 231 are cleaned. However, for example, in a state where a small amount of used paper Pu is left in the tray 211 of one of the paper feed units (Specifically, a state where the limit of the number of papers stored in the tray 211 is 300, 280 papers are fed and 20 papers are left), switching to another paper feed unit may be performed for cleaning.

In this way, even if an error occurs in the other paper feed unit that has been switched, since the used paper Pu remains in one of the paper feed units, the paper feeding processing is switched to one of the paper feed units. Thereby, the degradation of the operation rate of the supply unit 10 can be suppressed.

Modification Example 4

The first cleaning unit 400A and the second cleaning unit 400B in the first embodiment and the like include the air discharge units 401 and 402 and are configured to spray the air toward the pickup roller 230 and the double feed prevention roller 231. However, the air discharge units 401 and 402 may be movable, and an air spray angle to the pickup roller 230 or the double feed prevention roller 231 may be changed. In this manner, the effect of removing paper dust and the like can be further enhanced.

Modification Example 5

The first cleaning unit 400A and the second cleaning unit 400B in the first embodiment and the like include the air discharge units 401 and 402 and are configured to spray the air toward the pickup roller 230 and the double feed prevention roller 231. However, it is not limited thereto. For example, the configuration may be a suction device capable of suctioning foreign substance such as paper dust adhering to the pickup roller 230 and the double feed prevention roller 231. Also in this manner, the foreign substance such as paper dust adhering to the pickup roller 230 and the double feed prevention roller 231 can be removed.

Modification Example 6

The first cleaning unit 400A and the second cleaning unit 400B in the first embodiment and the like include the air discharge units 401 and 402 and are configured to blow air toward the pickup roller 230 and the double feed prevention roller 231. However, it is not limited thereto. For example, the foreign substances may be wiped off with a brush or a web. Furthermore, the first cleaning unit 400A and the second cleaning unit 400B may be combined with a brush roller, a web cleaner, and the like. Also in this manner, the foreign substance such as paper dust adhering to the pickup roller 230 and the double feed prevention roller 231 can be removed.

Modification Example 7

In the third embodiment, the detection sensor 700 for detecting the conveyance time of the used paper Pu is applied as prediction means for predicting the time to clean the surface of the pickup roller 230 and the double feed prevention roller 231. However, it is not limited thereto. For example, images of the surfaces of the pickup roller 230 and the double feed prevention roller 231 are acquired, the degree of contamination of each roller is determined from the acquired images, and it is determined whether cleaning is necessary based on the determination result to perform cleaning. Even in this manner, the same effect as described above can be obtained.

Modification Example 8

In the first embodiment and the like, the configuration in which the supply unit 10 is mounted on the dry sheet manufacturing apparatus 100 is described as an example. However, it is not limited to thereto. For example, the supply unit 10 may be placed on a wet sheet manufacturing apparatus. Even in this manner, the same effect as described above can be obtained.

Modification Example 9

In the first embodiment and the like, as a paper feed unit, a configuration including the tray 211 for storing used paper Pu and the moving mechanism 221 for moving the tray 211 is described as an example. However, it is not limited thereto. For example, a supply unit having a structure that the lowermost used paper Pu of the stacked used paper Pu is fed by a roller may be used. In this configuration, the used paper at the bottom is held down by the weight of the used paper Pu, and there are few problems such as the used paper being blown off by the cleaning air. Further, at the time of cleaning, the pickup roller may be retracted away from the used paper Pu.

REFERENCE SIGNS LIST

10, 1000, 1001 SUPPLY UNIT (USED PAPER SUPPLY DEVICE)
10A FIRST SUPPLY UNIT
10B SECOND SUPPLY UNIT
100 SHEET MANUFACTURING APPARATUS
110 CONTROLLER
200A FIRST PAPER FEED UNIT
200B SECOND PAPER FEED UNIT
211 TRAY
221 MOVING MECHANISM
230 PICKUP ROLLER (ROLLER)
231 DOUBLE FEED PREVENTION ROLLER (ROLLER)
240 LEVEL SENSOR
300 DETECTION UNIT
400A FIRST CLEANING UNIT
400B SECOND CLEANING UNIT
401, 402 AIR DISCHARGE UNIT
401*a*, 402*a* NOZZLE
501, 502 COVER
601, 602 CLOCKING FUNCTION UNIT
700 DETECTION SENSOR
701 FIRST DETECTION SENSOR (A PART OF PREDICTION MEANS)
702 SECOND DETECTION SENSOR (A PART OF THE PREDICTION MEANS)

The invention claimed is:

1. A used paper supply device comprising:
a first paper feed unit and a second paper feed unit each of which feeds used paper and includes
a tray that stores the used paper to be fed, and
a moving mechanism that moves the tray between a paper feed position at which the used paper is fed and a retracted position that is retracted from the paper feed position;
an air discharging unit that discharges an air toward a surface of a roller of each of the paper feed units; and
a controller configured to control the first paper feed unit, the second paper feed unit, and the air discharging unit,
wherein the controller is configured to control the moving mechanism of the first paper feed unit to move the tray of the first paper feed unit to the paper feed position, to control the first paper feed unit to feed the used paper, and configured to control the moving mechanism of the second paper feed unit to move the tray of the second paper feed unit to the retracted position, to control the air discharging unit to discharge the air toward the surface of the roller of the second paper feed unit, and
the controller is configured to control the air discharging unit to discharge the air toward the surface of the roller of the second paper feed unit when the tray of the second paper feed unit is positioned at the retracted position, while the controller controls the first paper feed unit to feed the used paper when the tray of the first paper feed unit is positioned at the paper feed position.

2. The used paper supply device according to claim 1, wherein the controller is configured to control the air discharging unit to discharge the air toward the surface of the roller of the first paper feed unit each time the controller controls the first paper feed unit to feed a predetermined number of sheets, a predetermined length or a predetermined weight of the paper.

3. The used paper supply device according to claim 1, wherein the controller is configured to control the air discharging unit to discharge the air toward the surface of the roller of the first paper feed unit each time a paper feeding state of the first paper feed unit passes a predetermined time.

4. The used paper supply device according to claim 1, further comprising:

a detection sensor that predicts at least a timing to discharge the air toward the surface of the roller of the first paper feed unit, wherein the controller is configured to control the air discharging unit to discharge the air toward the surface of the roller of the first paper feed unit in accordance with the timing that is predicted by the detection sensor.

5. The used paper supply device according to claim 1, wherein a cover that covers the roller is provided near the roller and on an upstream side of the roller.

6. A sheet manufacturing apparatus comprising:

the used paper supply device according to claim 1.

* * * * *